US006254014B1

(12) United States Patent
Clearman et al.

(10) Patent No.: US 6,254,014 B1
(45) Date of Patent: Jul. 3, 2001

(54) FLUID DELIVERY APPARATUS

(75) Inventors: Joseph H. Clearman, Port Gamble, WA (US); Jack F. Clearman, Blakely, GA (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 09/352,518

(22) Filed: Jul. 13, 1999

(51) Int. Cl.[7] ..... B05B 3/02

(52) U.S. Cl. ..... 239/222.15; 239/222.11; 239/222.17; 239/222.21; 239/383; 239/389; 239/428.5

(58) Field of Search ..... 239/222.15, 428.5, 239/380, 383, 389, 222.13, 222.17, 222.19, 222.21

(56) References Cited

U.S. PATENT DOCUMENTS

| | | | |
|---|---|---|---|
| 2,151,214 | | 3/1939 | Kramer . |
| 2,186,786 | | 1/1940 | Jensen . |
| 2,622,927 | | 12/1952 | Sarbu . |
| 2,639,191 | | 5/1953 | Hruby, Jr. . |
| 2,831,333 | | 4/1958 | Smith . |
| 2,848,276 | | 8/1958 | Clearman . |
| 2,854,283 | * | 9/1958 | Hruby, Jr. ..... 239/237 |
| 2,902,851 | | 9/1959 | Fields . |
| 2,931,201 | | 4/1960 | Hubbard . |
| 2,954,171 | | 9/1960 | Hruby, Jr. . |
| 2,967,024 | | 1/1961 | Aubert . |
| 2,974,877 | | 3/1961 | Hruby, Jr. . |
| 3,000,575 | | 9/1961 | Hruby, Jr. . |
| 3,009,648 | | 11/1961 | Hait . |
| 3,034,728 | | 5/1962 | Hruby, Jr. . |
| 3,091,400 | | 5/1963 | Aubert . |
| 3,126,025 | | 3/1964 | Aubert et al. . |
| 3,357,643 | | 12/1967 | Hruby, Jr. . |
| 3,447,749 | | 6/1969 | Hruby, Jr. . |
| 3,734,410 | | 5/1973 | Bruno . |
| 3,791,584 | | 2/1974 | Drew . |
| 3,826,429 | | 7/1974 | Moen . |
| 3,880,357 | | 4/1975 | Baisch . |
| 3,929,287 | | 12/1975 | Givler . |
| 4,018,385 | | 4/1977 | Bruno . |
| 4,026,470 | | 5/1977 | Crist . |
| 4,073,438 | | 2/1978 | Meyer . |
| 4,117,979 | | 10/1978 | Lagarelli . |
| 4,457,343 | | 7/1984 | Zukausky . |
| 4,478,367 | | 10/1984 | Petursson . |

(List continued on next page.)

FOREIGN PATENT DOCUMENTS

| | | |
|---|---|---|
| 42 21 587 A1 | 1/1994 | (DE) . |
| 42 24 664 A1 | 1/1994 | (DE) . |
| 0676241 | 3/1995 | (EP) . |
| 0836888 | 10/1997 | (EP) . |
| 0841096 | 11/1997 | (EP) . |
| 03231620 | 2/1990 | (JP) . |

OTHER PUBLICATIONS

Michael D. Handler, PCT Publication #WO 93/08785, May 13, 1993, 2 pages.

*Primary Examiner*—David A. Scherbel
*Assistant Examiner*—Dinh Q. Nguyen
(74) *Attorney, Agent, or Firm*—Cook, Alex, McFarron, Manzo, Cummings & Mehler, Ltd.

(57) ABSTRACT

The present invention provides an apparatus with a moving nozzle that delivers fluid in a wobbling, rotating or oscillating pattern. The movement of the nozzle is a wobbling motion, preferably combined with some rotational motion. The wobbling motion is generated by disposing a wobble inducing member or wobble turbine in the path of the fluid supply. The water flowing over the wobble turbine causes the turbine to wobble. The wobbling turbine then causes the nozzle to wobble or rotate. The moving nozzle can be used as a motor providing a rotating output shaft or ring.

32 Claims, 13 Drawing Sheets

U.S. PATENT DOCUMENTS

| | | | |
|---|---|---|---|
| 4,487,368 | 12/1984 | Clearman . | |
| 4,508,144 | 4/1985 | Bernett . | |
| 4,542,853 | 9/1985 | Diamond . | |
| 4,629,404 | 12/1986 | Raymond . | |
| 4,754,925 | 7/1988 | Rubinstein . | |
| 4,801,091 | 1/1989 | Sandvik . | |
| 4,802,628 | 2/1989 | Dautel . | |
| 4,828,179 | 5/1989 | Garner . | |
| 4,838,486 | 6/1989 | Finkbeiner . | |
| 4,933,999 | 6/1990 | Mikiya et al. . | |
| 4,944,457 | 7/1990 | Brewer . | |
| 4,951,877 | 8/1990 | Arsi . | |
| 4,989,786 | 2/1991 | Kranzle et al. . | |
| 5,058,220 | 10/1991 | Mikiya . | |
| 5,108,035 | 4/1992 | Friedrichs . | |
| 5,141,153 | 8/1992 | Jeffress . | |
| 5,163,615 | 11/1992 | Bauer . | |
| 5,201,468 | 4/1993 | Freier et al. . | |
| 5,217,166 | 6/1993 | Schulze . | |
| 5,248,092 | 9/1993 | Rankin . | |
| 5,294,054 | 3/1994 | Benedict et al. . | |
| 5,316,216 | 5/1994 | Cammack et al. . | |
| 5,328,097 | 7/1994 | Wesch et al. . | |
| 5,332,155 | 7/1994 | Jager . | |
| 5,381,960 | 1/1995 | Sullivan et al. . | |
| 5,395,053 | 3/1995 | Frech . | |
| 5,439,174 | 8/1995 | Sweet . | |
| 5,467,927 | 11/1995 | Lee . | |
| 5,504,955 | 4/1996 | Mueller et al. . | |
| 5,507,053 | 4/1996 | Mueller et al. . | |
| 5,518,181 | 5/1996 | Shames et al. . | |
| 5,551,635 | 9/1996 | Jager . | |
| 5,577,664 | 11/1996 | Heitzman . | |
| 5,588,595 | 12/1996 | Sweet . | |
| 5,598,975 | 2/1997 | Jager . | |
| 5,671,885 | 9/1997 | Davisson . | |
| 5,697,392 | 12/1997 | Johnson et al. . | |
| 5,704,547 | 1/1998 | Golan . | |
| 5,722,592 | 3/1998 | Jager . | |
| 5,810,257 | 9/1998 | Ton . | |
| 5,918,811 | 7/1999 | Denham et al. . | |
| 5,950,927 * | 9/1999 | Elliott et al. | 239/222.21 |

* cited by examiner

FIG. 5
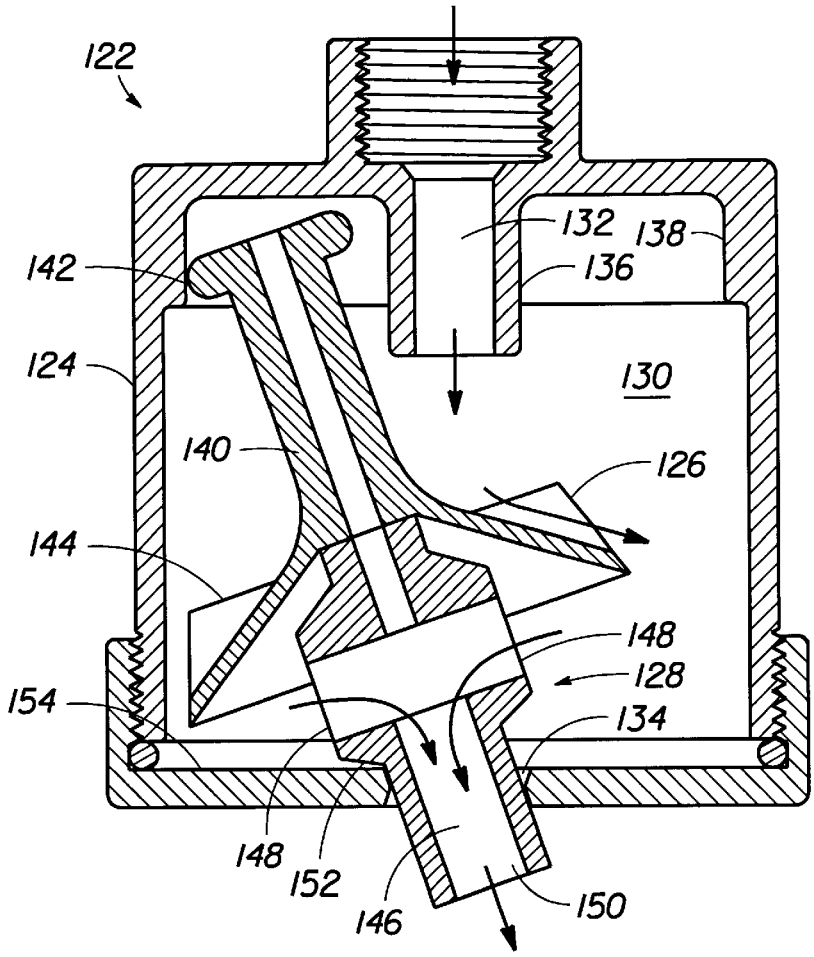
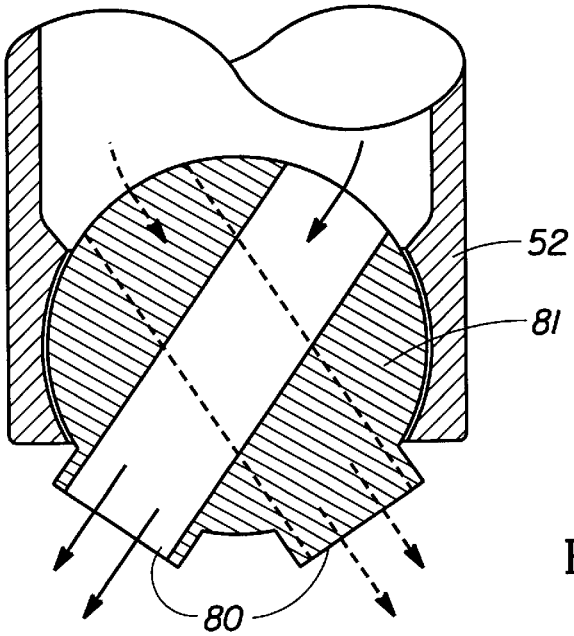
FIG. 6

FLUID DELIVERY APPARATUS

BACKGROUND OF THE INVENTION

1. Field of the Invention

This invention relates to a spray head having a rotary nozzle.

2. Background of the Related Art

Spray heads are commercially available in numerous designs and configurations for use in showers, faucets, whirlpools, sprinklers, and industrial processes. While many spray heads are designed and sold for their decorative styling, there is a great number of different showerhead mechanisms which are intended to improve or change one or more characteristic of the water spray pattern. Any particular spray pattern may be described by the characteristics of spray width, spray distribution or trajectory, spray velocity, and the like. Furthermore, the spray pattern may be adapted or designed for various purposes, including a direct jet stream for massaging of muscles, a pulsed jet, or a more uniform soothing spray or jet, to name a few.

The vast majority of spray heads may be categorized as being either stationary or oscillating and having either fixed or adjustable openings or jets. Stationary spray heads with fixed jets are the simplest of all spray heads, consisting essentially of a water chamber and one or more jets directed to produce a constant pattern. Stationary spray heads with adjustable jets are typically of a similar construction, except that it is possible to make some adjustment of the jet opening size and/or the number of jets utilized. However, these types of jets provide a straight often piercing directed flow of water.

These stationary spray heads cause water to flow through its apertures and contact essentially the same points on a user's body in a repetitive fashion. Therefore, the user feels a stream of water continuously on the same area and, particularly at high pressures or flow rates, the user may sense that the water is drilling into the body, thus diminishing the positive effect derived from such a spray head. In order to reduce this undesirable feeling, various attempts have been made to provide oscillating sprayheads.

Examples of oscillating sprayheads include the showerheads disclosed in U.S. Pat. No. 3,791,584 (Drew et al.), U.S. Pat. No. 3,880,357 (Baisch), 4,018,385 (Bruno), U.S. Pat. No. 4,944,457 (Brewer), and U.S. Pat. No. 5,577,664 (Heitzman). U.S. Pat. No. 4,944,457 (Brewer) discloses an oscillating showerhead that uses an impeller wheel mounted to a gear box assembly which produces an oscillating movement of the nozzle. Similarly, U.S. Pat. No. 5,577,664 (Heitzman) discloses a showerhead having a rotary valve member driven by a turbine wheel and gear reducer for cycling the flow rate through the housing between high and low flow rates. Both of these showerheads require extremely complex mechanical structures in order to accomplish the desired motion. Consequently, these mechanisms are prone to failure due to wear on various parts and mineral deposits throughout the structure.

U.S. Pat. No. 3,691,584 (Drew et al.) also discloses an oscillating showerhead, but utilizes a nozzle mounted on a stem that rotates and pivots under forces places on it by water entering through radially disposed slots into a chamber around a stem. Although this showerhead is simpler than those of Brewer and Heitzman, it still includes a large number of piece requiring precise dimensions and numerous connections between pieces. Furthermore, the Drew showerhead relies upon small openings for water passageways and is subject to mineral buildup and plugging with particles.

U.S. Pat. No. 5,467,927 (Lee) discloses a showerhead with an apparatus having a plurality of blades designed to produce vibration and pulsation. One blade is provided with an eccentric weight which causes vibration and an opposite blade is provided with a front flange which causes pulsation by momentarily blocking the water jets. Again, the construction of this showerhead is rather complex and its narrow passageways are subject to mineral buildup and plugging with particulates.

U.S. Pat. No. 5,704,547 (Golan et al.) discloses a shower head including a housing, a turbine and a fluid exit body, such that fluid flowing through the turbine causes rotation of the turbine. The rotating (spinning) turbine can be used to cause rotation of the fluid exit body and/or a side-to-side rocking motion in a pendulum like manner.

U.S. Pat. No. 4,073,438 (Meyer) discloses a sprinkler head having a housing with an inlet, a water distributing structure having a nozzle on one end and a cup shaped element at the opposite end which is operative in response to the tangential flow of water into the housing for effecting the orbital movement of the nozzle. There is also disclosed a disk that rotates in rolling contact with a surface within the housing for effecting the fractional rotation of the nozzle. The cup shaped element rotates about the longitudinal axis in response to the flow of water from the inlet.

A particularly useful action for a showerhead is referred to as "wobbling." The term "wobbling" may be defined as the motion of a circular member rolling on its edge along a surface following a circular path. A common example of wobbling is what occurs when a coin is spun on its edge over a smooth surface. The coin begins spinning or rotating in a vertically upright position, but as the coin slows, the coin begins to wobble along a circular path having an ever increasing diameter until the coin comes to rest on its face. While a wobbling motion will often be accompanied by some degree of rotation, a wobbling member will have points on its surface which experience a sequence of up and down motions as well.

Whirlpool baths are equipped with nozzles that cause the water in the bath to be turbulent and waving, preferably to impart a massaging of the skin and muscles or a gentle rocking of the body. This is typically accomplished with high pressure water jets that draw water from the bath and circulate it back into the bath at a high pressure and flow rate. However, due to the size of a typical whirlpool bath and the flow rates required to operate the whirlpool bath, there are typically about six or eight nozzles in a whirlpool bath. This finite number of nozzles causes general agitation of the bath water, but the water flowing from individual nozzles is fixed and may channel through the bath water in a fairly constant path.

Therefore, there is a need for an improved apparatus that delivers water in a continually changing manner, such as wobbling, rotating, and the like. It would be desirable if the apparatus were able to deliver water in the desired manner, even at low pressures or flow rates, perhaps those dictated or desirable for water or energy conservation. It would be further desirable if the apparatus provided a simple design and construction with minimal restriction to water flow and open conduits for reducing the possibility or extent of plugging.

SUMMARY OF THE INVENTION

The present invention provides a fluid discharging apparatus comprising a housing having a fluid inlet and a collar in an axially spaced relationship to the fluid inlet, a wobble inducing member disposed within the housing in an axially spaced relationship between the fluid inlet and the collar, a nozzle assembly coupled to the wobble inducing member, wherein the nozzle assembly has a fluid conduit extending through the collar to provide fluid communication between the housing and a fluid outlet at a distal end of the conduit, and a wobble limiting member secured to the housing, wherein the wobble limiting member encircles the nozzle assembly. The wobble turbine has a plurality of stream distributing members configured to cause the wobble turbine to rotate when struck by a stream emitted from the fluid inlet. The wobble limiting member may be formed in several manners, including a track formed in the housing adjacent the fluid inlet and the wobble turbine is in rolling contact with the track, an elongated cylindrical collar, a slot formed in the housing for receiving a wobble plate on the nozzle assembly, a plate extending from the housing into a slot on the nozzle assembly, a wall forming part of the housing, and a cylindrical sleeve disposed around a portion of the nozzle assembly. Optionally, the housing may further comprise an air passage extending into fluid communication with the fluid outlet. The nozzle assembly may be coupled to the wobble inducing member, such as a wobble turbine, in a fixed relationship, a loose male-female relationship, a post and sleeve relationship, a wobbling relationship. The apparatus my have an adjustable spray width by providing the nozzle assembly with a wobble plate and having a wobble limiting member that is a slot having an adjustable width. In one particular embodiment, the nozzle includes a pressurized fluid chamber having a plurality of outlet orifices and a reduced pressure fluid chamber having a plurality of outlet channels.

The invention also provides a fluid driven motor comprising: a housing having a fluid inlet, a fluid outlet and a collar in an axially spaced relationship to the fluid inlet; a wobble inducing member disposed within the housing in an axially spaced relationship between the fluid inlet and the collar; a cradle assembly forming a cradle for receiving the wobble inducing member in a post and sleeve relationship and a post extending into the collar; and a wobble limiting member secured to the housing, wherein the wobble limiting member encircles the cradle assembly. The motor may also include an output member secured in axial alignment with the cradle assembly post by one or more bearings affixed to the housing, wherein the output member is rotationally coupled to the post. The output member may take many forms, such as a ring forming drive gears or a rotating shaft. Optionally, the fluid outlet from the motor may be in the side of the housing.

BRIEF DESCRIPTION OF THE DRAWINGS

So that the above recited features and advantages of the present invention can be understood in detail, a more particular description of the invention, briefly summarized above, may be had by reference to the embodiments thereof which are illustrated in the appended drawings. It is to be noted, however, that the appended drawings illustrate only typical embodiments of this invention and are, therefore, not to be considered limiting of its scope, because the invention may admit to other equally effective embodiments.

FIG. 5 is a cross-sectional side view of a fifth embodiment of an apparatus of the present invention;

FIG. 6 is a cross-sectional side view of an alternate outlet channel for use with the apparatus shown in FIGS. 2 and 3;

DETAILED DESCRIPTION OF THE INVENTION

Figure 1:
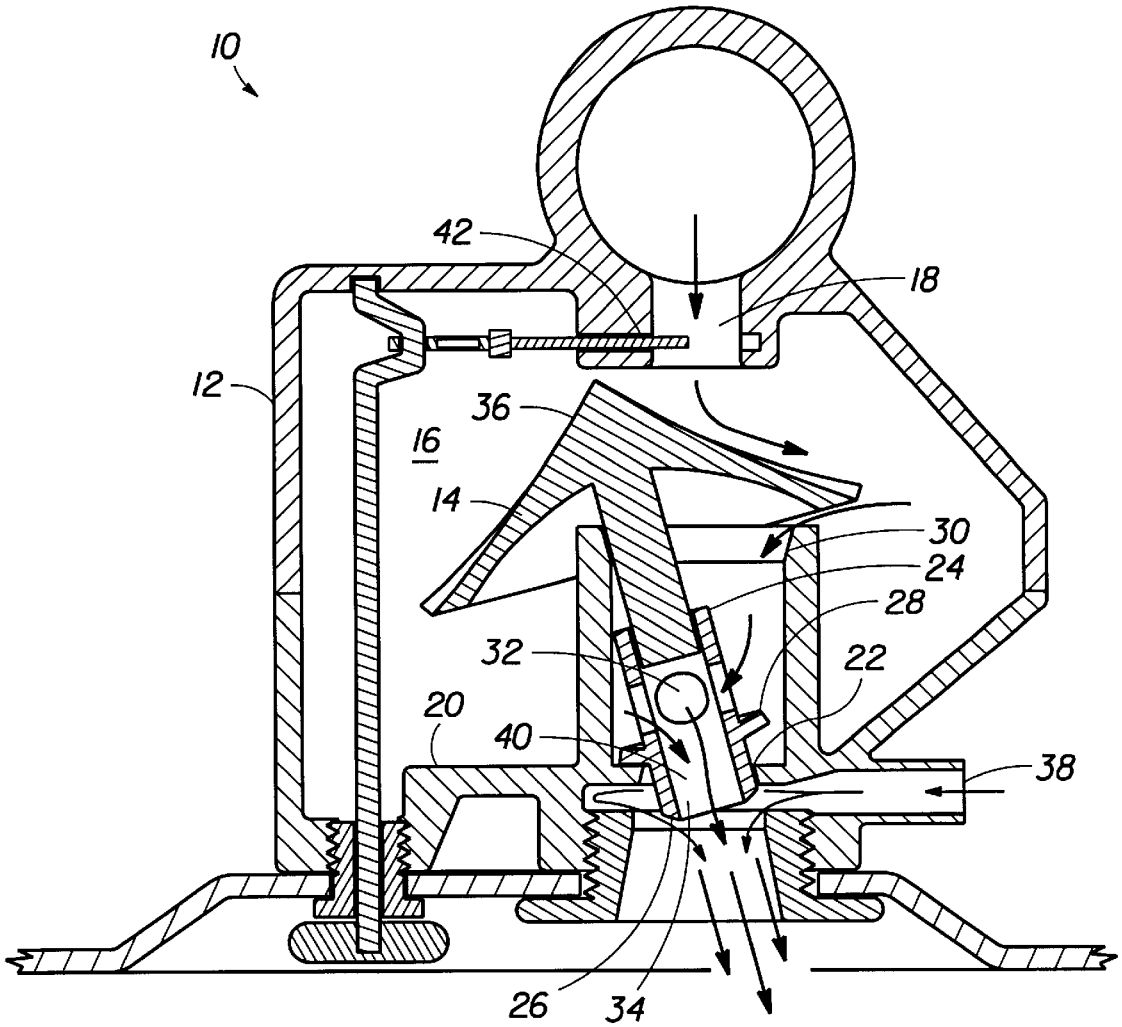
FIG. 1 is a cross-sectional side view of a first embodiment of an apparatus of the present invention.

The present invention provides an apparatus with a moving nozzle that delivers fluid for use in various applications, such as, but not limited to, whirlpool baths or showers. The movement of the nozzle may include a wobbling motion, a rotational motion, an arcuate motion, an oscillating motion or a combination of these motions. The movement of the nozzle is powered by disposing a wobble inducing member, such as a wobble turbine, in the path of the fluid supply inside a housing. The water flowing over the wobble turbine causes the wobble turbine to wobble. The wobbling turbine imparts movement to the nozzle in accordance with a defined arcuate path. Movement of the nozzle, or at least redirection of the nozzle outlet, provides a more satisfying whirlpool bath experience than many stationary nozzles. An advantage of the unique design of the wobble turbine is that it does not include complex mechanical parts or cause significant flow restrictions.

One aspect of the present invention provides an apparatus with a wobble inducing member or wobble turbine that is directly engaged with the nozzle. The nozzle may have any number of outlet channels, but preferably has less than about five outlet channels and most preferably has only one or two outlet channels directing the fluid at the same or different angles. The wobble turbine is preferably mounted on a post positioned inside a sleeve or track, where the top conical surface of the wobble turbine faces the water inlet. Because the post has a smaller diameter than the inside surface of the sleeve or track, the number of rotations the turbine must take for each wobble acts to reduce or control the speed of the wobble. The sleeve can form an oval receptacle that causes a flattening of the angle of rotation of the nozzle in accordance with an axis of the oval. Optionally, air may be introduced into the flow path of the water as it passes through or as it exits the apparatus to provide an aerated jet of water for contacting the skin. It should be recognized that when the detailed description of the invention discusses a wobble inducing member having a post and a nozzle assembly having a sleeve, the scope of the present invention and each of the embodiments disclosed also includes the wobble turbine having a sleeve and a nozzle assembly having a post. In fact, aspects of the present invention may be operable in combination with other coupling members that are capable of supporting the wobble inducing member while allowing it to wobble and rotate.

Another aspect of the invention provides an apparatus that may include more than one outlet channel, but preferably has two outlet channels at opposing angles to the centerline of the apparatus. In this arrangement, a wobble turbine is loosely received in a sleeve that is attached to the nozzle, so that as the wobble turbine wobbles, the nozzle wobbles. Because the nozzle is wobbling independent of the wobble turbine, the distribution or coverage of fluid over a surface is extremely uniform. The opening in the housing through which the nozzle assembly is received has a slightly larger diameter than the nozzle assembly such that the difference in the diameter can be used to determine the rotational speed of the nozzle. For example, if the inner diameter of the opening is 0.51 inches and the outer diameter of the nozzle assembly is 0.5 inches, with each wobble of the wobble turbine, the nozzle assembly will rotate approximately 0.0314 inches or $1/50^{th}$ of its circumference in a direction opposite the wobble, resulting in one complete revolution for every fifty wobbles. If the wobble turbine is wobbling at 1800 wobbles per minute (wpm), then the nozzle assembly would rotate at 36 rpm.

Yet another aspect of the invention provides a wobble limiting member. Optionally, the wobble limiting member can be adjusted manually by the user to obtain the desired jet from the apparatus. The speed of the wobble can be adjusted by allowing the wobble turbine to tilt more or less. The degree of tilt affects the radius of the wobble turbine at which the water stream strikes. A small tilt will result in a higher rotations per minute (rpm) than a large tilt for any turbine having a given cone angle, surface area and groove angle/size.

Wobble limiting members in accordance with the present invention may be formed in a variety of configurations to define the travel of the wobble inducing member. These wobble limiting members include, but are not limited to, tracks, walls, plates, slots, sleeves or cylinders, posts. The invention utilizes any of a number of combinations of wobble limiting members and wobble inducing members or even portions of wobble inducing members. Exemplary combinations include (*a*) a turbine post limited by a sleeve (See FIG. 1), (*b*) a nozzle post limited by a cylinder (See FIGS. 2 and 7–10), (*c*) a wobble plate limited by a slot (See FIG. 3), (*d*) a wobble slot limited by a plate (See FIG. 4), (*e*) a wheel limited by a track (See FIG. 5), and (*f*) a turbine body limited by the chamber wall (See FIG. 11). However, these and other combinations will become apparent to those of ordinary skill in the art in light of the present disclosure and are included within the scope of the present invention.

While the wobble inducing member may be coupled, held or otherwise secured to a nozzle, it is generally preferred not to integrate or affix the wobble inducing member to the nozzle. More particularly, the nozzle has an end that is proximal to the wobble inducing member. It is preferred that this proximal end of the nozzle and the wobble inducing member receive each other in a loose male-female relationship, particularly where the proximal end and the wobble inducing member can easily slide or pivot into the appropriate relationship without restriction. One particularly preferred arrangement is a post and sleeve relationship in which a cylindrical post (male) is received within a cylindrical sleeve (female), where the outer diameter of the post is less than the inner diameter of the sleeve. Alternatively, the post may form a frusto-conical surface (male) received within a frusto-conical sleeve (female), where the frusto-conical angle of the post is less than the frusto-conical angle of the sleeve. It should be recognized that the post may be part of the nozzle assembly and the sleeve may be part of the wobble inducing member, or vice versa. It is preferred to design the post and sleeve with sufficient tolerances therebetween so that the wobble inducing member can wobble in relation to the nozzle assembly without binding. Furthermore, it is most preferred to utilize a wobble inducing member having a conical or frusto-conical post of a first diameter received in a conical or frusto-conical sleeve of the nozzle assembly. Examples of various wobbling spray head assemblies that can be adapted for use in the present invention are described in co-pending U.S. patent application Ser. No. 09/115,362 which is incorporated by reference in its entirety herein.

One advantage of the loose fitting relationship of the wobble inducing member or wobble turbine to the nozzle assembly is that there is very little friction or forces to be overcome before the wobble turbine will begin wobbling. In this manner, the initiation and maintenance of a wobbling motion of the nozzle of the present invention is substantially independent of fluid flow rate and operates very effectively in shower heads even at flow rates much lower than the 2.5 gallons per minute maximum imposed by the laws of many states.

A second advantage of the loose fitting relationship is that the wobble turbine is easily cocked, shifted or tilted away from the centerline of the fluid supply inlet. In fact, even when no fluid is being passed through the apparatus, the wobble turbine may rest at a cocked angle relative to the centerline of the housing. In order to provide the most effective wobbling motion, it is desirable for the wobble turbine to be shifted sufficiently away from the centerline of the fluid supply so that a major portion of the fluid supply is being directed at the wobble turbine face on one side of the apex. The loose fitting relationship allows the apparatus of the present invention to achieve a sufficient shifting of the wobble turbine within a much shorter axial distance than where the wobble turbine is integral to the nozzle.

Another embodiment or aspect of the invention provides a fluid powered motor capable of driving various devices, such as a nozzle assembly, moving sprinker or a secondary pump. This motor is particularly useful in applications requiring a low output speed, because the complexity of reduction gears would probably be unnecessary. The motor is provided by a wobble inducing member in a post/sleeve relationship with a drive assembly or nozzle assembly, wherein the wobble of the drive assembly or nozzle assembly is limited or constrained by a wobble limiting member. While the wobbling of the drive assembly is limited, the drive assembly is still allowed to rotate within the wobble limiting member and the drive assembly forms a motor output shaft. The wobble limiting member is preferably a slot (engaging a wobble plate on the drive assembly or nozzle assembly), a plate (engaging a wobble slot in the drive assembly or nozzle assembly), or a cylinder (engaging a post on the drive assembly or nozzle assembly). The wobble limiting member should engage the drive or nozzle assembly within certain dimensional tolerances to restrict the degree of wobble (the maximum angle away from the central axis) imparted to the assembly. While the degree of wobble that can be tolerated is expected to be dependent upon the intended use of the motor output, the degree of wobble should generally be less than a five (5) degree angle off center, preferably less than a two (2) degree angle off center. It should be recognized that the motor output shaft may be coupled to any device without limitation, whether that device is integral to the shaft (such as an off-center drive pin), in a loose-fitting engagement with the shaft, coupled to the shaft, or in a temporary or conditional attachment to the shaft. One preferred motor shaft includes a fluid passage therethrough to form a nozzle assembly. Another preferred motor shaft engages a separate nozzle assembly in any known manner to provide a simple (circular, oscillating or reciprocating, etc.) or complex (elliptical, sweeping, etc.) motion of the nozzle assembly. Such a separate nozzle assembly is preferably supported in the housing on an axle or a ball and socket type attachment extending through the center of the assembly. The nozzle assembly can be a spherical or cylindrical shape and a drive slot in the assembly can be designed to produce the desired flow pattern exiting the nozzle.

Another aspect of the invention provides an apparatus that may include more than one outlet channel, preferably at least one channel is aligned with the centerline of the apparatus, with the remaining channels positioned at opposing angles to the centerline of the apparatus. In addition, the chamber surrounding the wobble turbine and nozzle assembly is not required to be much larger than the nozzle assembly itself. The reduced size provides for efficient channeling of the fluid with very little loss of velocity, making this design useful for areas with low water pressure.

In an alternative embodiment, the wobble turbine is fixed to the nozzle assembly. The wobble turbine rotates in response to fluid flowing into the chamber and the fluid flows out of the nozzle assembly to provide a uniform flow pattern. This design is particularly useful in areas with low water pressure, because the water entering the nozzle can be made to lift the wobble turbine/nozzle assembly up out of the collar or slot, thus allowing the whole assembly to rotate easily.

In yet another embodiment of the present invention, the wobble turbine and post are attached to a nozzle that has a combination or both high and low pressure chambers. The water flows off of the wobble turbine and through the post as described above, however, the water then flows into a high pressure chamber having high pressure outlets which emit small droplets of water at high speeds. A portion of the water is directed to a low pressure chamber through a flow control member, the chamber having low pressure outlets, where larger, low velocity water droplets exit the nozzle. The large and small droplets preferably exit the nozzle at different speeds, thus producing two patterns of droplets that provide the bather with uniform coverage and a satisfying flow rate of water.

It should be recognized that the apparatus of the present invention, and the individual components thereof, may be made from any known materials that are resistant to chemical and thermal attack by the fluid passing therethrough. Where the fluid is water, the apparatus or components of the apparatus are preferably made from one or more injection moldable or extrudable plastic or polymer materials, most preferably an acetal resin such as DELRIN (a trademark of Du Pont de Nemours, E.I. 7 Co. of Wilmington, Del.). The apparatus may also include components made from metals or metal alloys, such as stainless steel. Other and further materials suitable for use in the present invention should be apparent to one of skill in the art and are considered to be within the scope of the present invention.

FIG. 1 is a cross-sectional view of an apparatus 10 of the present invention. The apparatus 10 has a housing 12 for holding a wobble turbine 14. The housing 12 forms a chamber 16 with an inlet 18 positioned upstream from the wobble turbine 14. The floor 20 or distal end of the housing 12 forms a collar, hole or opening 22 therethrough for slidably receiving a post 24 which is fixed to the wobble turbine 14 inside the housing 12, and a nozzle 26 through the collar 22. The post 24 is retained within the opening 22 by an annular shoulder 28 that allows the post 24 to rotate freely within the opening 22. The annular shoulder 28 may be tapered upwardly to provide a frusto-conical surface that contacts the floor 20 of the housing 12.

The wobble turbine 14 has a conical upper surface 36 forming a plurality of non-radial channels as shown in co-pending U.S. patent application Ser. No. 09/115,362. The upper surface 36 of the wobble turbine 14 preferably extends beyond the track 30 to form an annular overhang that faces the floor 20 of the housing 12. The wobble turbine 14 and the post 24 are preferably made from polytetrafluoroethelyene (PTFE), such as TEFLON (a registered trademark of DuPont de Nemours, Wilmington, Del.), or other suitable polymer material, to allow for some friction between the post 24 of the wobble turbine 14, and the track 30 while allowing the wobble turbine 14 to move freely within the bounds set by the track 30.

The housing forms a wobble limiting sleeve or nutating track 30 in which the wobble turbine 14 rotates. The track 30 has an inner diameter that is several times larger than the outer diameter of the post 24 that allows the wobble turbine 14 to roll around within the track 30 in a wobbling motion. The track acts to reduce the wobbling speed of the turbine 14. The track can have an oval opening (top view) to similarly flatten out the movement of the nozzle to an oval pattern and the flow path of the water exiting the nozzle in accordance with the oval dimensions. Air may be introduced into the flow path of the water through a port 38 as it exits the spray head to provide an aerated jet of water. The aerated jet may be desirable for contacting the skin in a whirlpool bath, where the nozzle releases the jet into a body of water.

The post 24 provides a passage 40 in fluid communication between the shaft inlet(s) 32 and the nozzle 34. The inlet 32 is preferably a plurality of channels that extend through the wall of the post, preferably angled downwardly from the top of the housing 12 toward the floor 20 of the housing 12.

Therefore, fluid follows a pathway by entering the chamber 16 through the inlet 18, passing over the wobble turbine 14, entering through inlet 32 into the passage 40 in the post 24, and exiting the nozzle 26 through a spray channel 34 in fluid communication with the passage 40 in the shaft 24. In operation, a fluid source under pressure, such as a water pipe from a residential or commercial tap water source or pump driven recirculating water, is in communication with the inlet 18 in the housing 12. The turbine 14 wobbles due to the fluid flowing over the upper surface 36 of the wobble turbine 14. "Wobbling" means essentially that the wobble turbine 14 tilts to one side so that the outside surface of the post 24 of the wobble turbine 14 is in rolling contact with the inside surface of the track 30. The wobble action of the wobble turbine exerts forces on the shaft 24 which are translated to the water exiting the passage 40 through the nozzle 26. Once the chamber is substantially filled with water, water therein enters the inlet in the shaft and flows through a passage in the shaft to the nozzle.

For any given wobble turbine, the wobble rate or speed may be increased (or decreased) by increasing (or decreasing) the flow rate of fluid through the spray head. Control of the flow rate can be accomplished by providing a valve 42, such as a gate valve, at the inlet 18.

Figure 2:
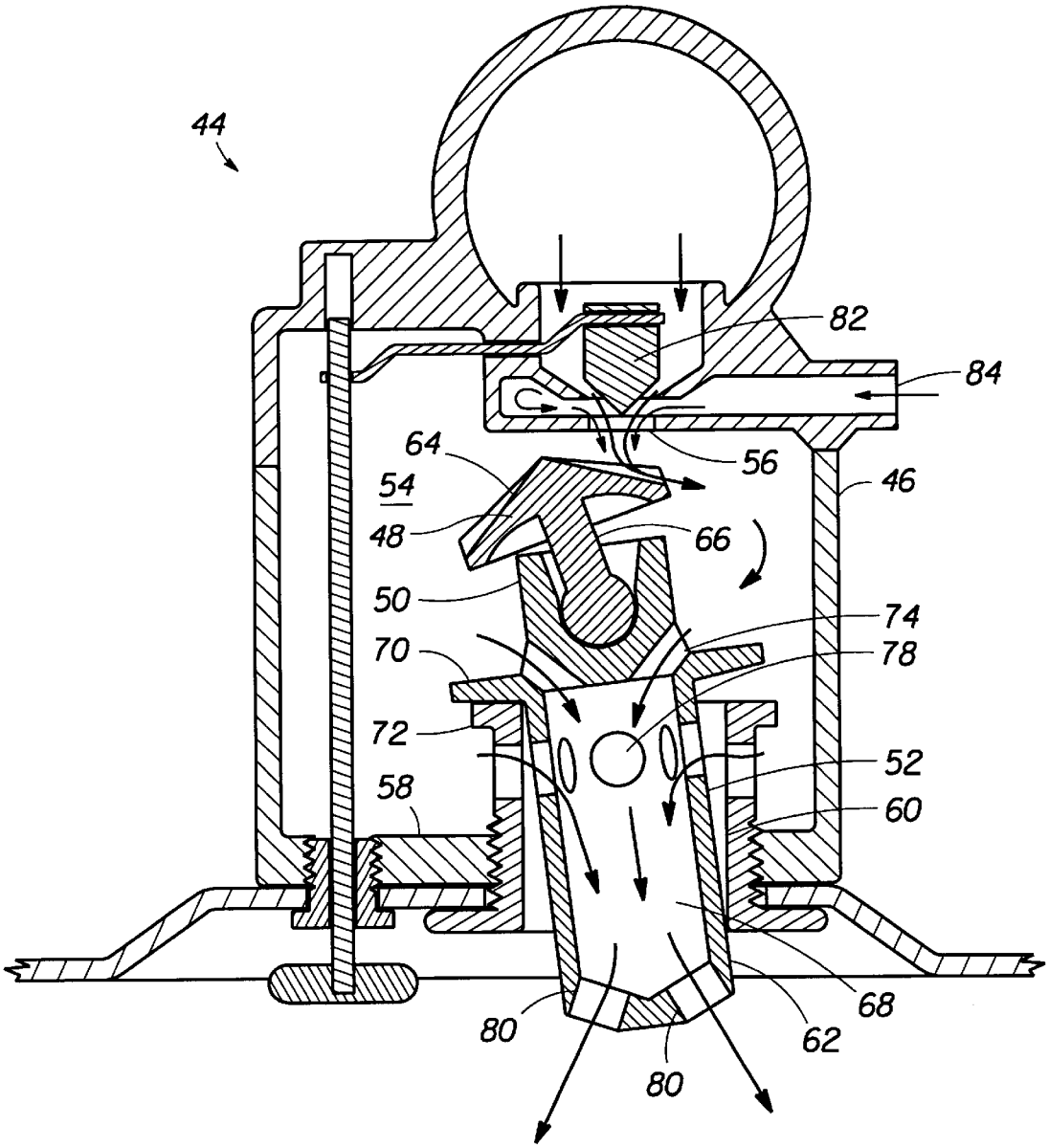
FIG. 2 is a cross-sectional side view of a second embodiment of an apparatus of the present invention.

FIG. 2 is a sectional view of another embodiment of the present invention. The apparatus 44 has a housing 46 for holding a wobble turbine 48 similar to that shown in FIG. 1. However, the wobble turbine 48 is loosely received in a sleeve 50 which is part of the nozzle assembly 52. The housing 46 forms a chamber 54 with an inlet 56 positioned upstream from the wobble turbine 48. The floor or distal end 58 of the housing downstream of the wobble turbine forms a collar, hole or opening 60 therethrough for slidably receiving the nozzle assembly 52, which has a nozzle 62 extending beyond the collar 60 and a sleeve 50 for supporting the wobble turbine 48.

The wobble turbine 48 has a conical upper surface 64 like the one described in FIG. 1, that is attached to a post 66. The upper surface 64 of the wobble turbine 48 preferably extends radially beyond post 66 to form an annular overhang. The outer diameter of the post 66 is smaller than the inner diameter of the sleeve 50 such that when the wobble turbine wobbles within the sleeve, the wobbling motion is translated to the nozzle 52.

The nozzle assembly 52 provides an elongated portion having an annular shoulder portion 70 that rests on an optional washer or bearing 72. The elongated portion of the nozzle assembly has fluid inlets 74 positioned above the annular shoulder 70 and fluid inlets 78 positioned below the shoulder 70. The elongated portion further forms a passage 68 providing fluid communication between the inlet(s) 74 and 78 and the nozzle 62. The inlets 74 are preferably a plurality of channels that extend through the wall of the nozzle, preferably angled downwardly from the top of the housing 46 toward the floor 58 of the housing. The inlets 78 preferably extend through the wall of the nozzle assembly, preferably angled downward and towards the centerline of the nozzle assembly 52. The nozzle 62 may provide one or more, preferably two, outlet channels 80 in fluid communication with the passage 68. The outlet channels are most preferably angled away from each other off the centerline of the nozzle assembly 52.

The opening 60 has a slightly larger inner diameter than the outer diameter of the nozzle assembly 52 that extends therethrough. This difference in diameter acts to control the speed of rotation of the nozzle assembly 52. For example, if the inner diameter of the opening 60 is 0.51 inches and the outer diameter of the nozzle assembly is 0.5 inches, with each 360° wobble of the wobble turbine 48, and hence one wobble of the nozzle assembly, then the nozzle assembly will rotate 0.0314 inches or $1/50^{th}$ of its circumference in a direction opposite the wobble, resulting in one complete revolution for every fifty wobbles. In this example, if the wobble turbine 48 is wobbling at 1800 rpm, then the nozzle assembly 52 would rotate at about 36 rpm.

The flow of water into the housing 46 can be regulated by a needle valve 82 or a gate valve like the one shown in FIG. 1. In addition, the water flow can be aerated by drawing air into the housing through port 84.

Figure 3:
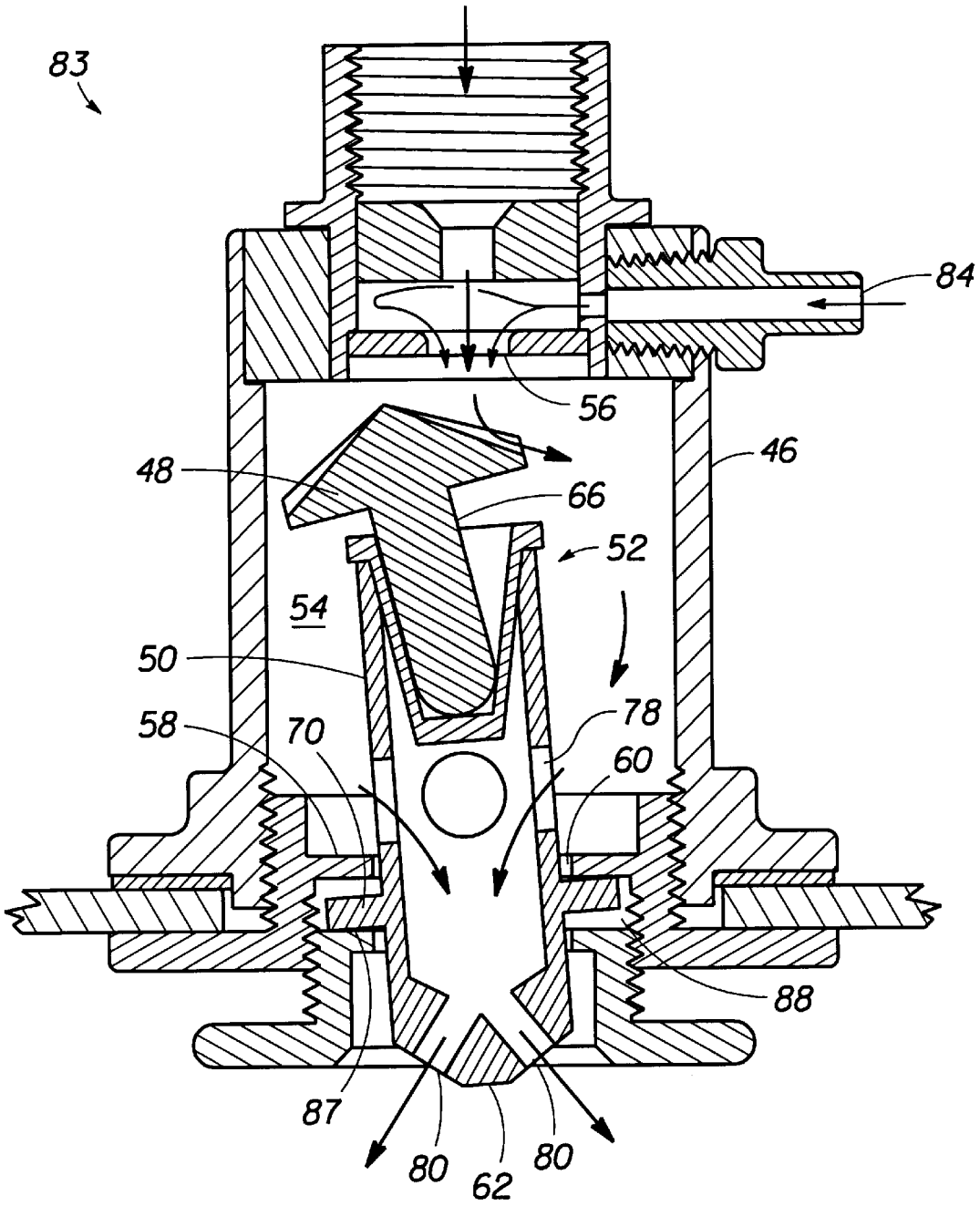
FIG. 3 is a cross-sectional side view of a third embodiment of an apparatus of the present invention.

FIG. 3 is a sectional view of an apparatus 83 similar to that shown in FIG. 2, in which like numerals label similar elements. The wobble turbine 48 is loosely received in a sleeve 50 which is part of the nozzle assembly 52. The housing 46 forms a chamber 54 with an inlet 56 positioned upstream from the wobble turbine 48. The floor 58 of the housing forms a collar, hole or opening 60 therethrough for slidably receiving the nozzle assembly 52, which has a nozzle 62 position outside the housing and the sleeve 50 for supporting the wobble turbine 48 inside the housing. The nozzle assembly 52 forms an annular shoulder 70 that is positioned in an adjustable slot 88. The width of the slot 88 can be adjusted by moving plate 87 up or down thereby limiting the wobble speed of the wobble turbine and in turn the wobble speed and tilt of the nozzle assembly 52. Decreasing the width of the slot (shown here as the vertical distance of the slot 88 between the floor 58 and plate 87) will result in a small tilt on the nozzle assembly 52 and a high RPM, where increasing the width of the slot will result in a greater tilt and lower RPM for the nozzle assembly.

Figure 4:
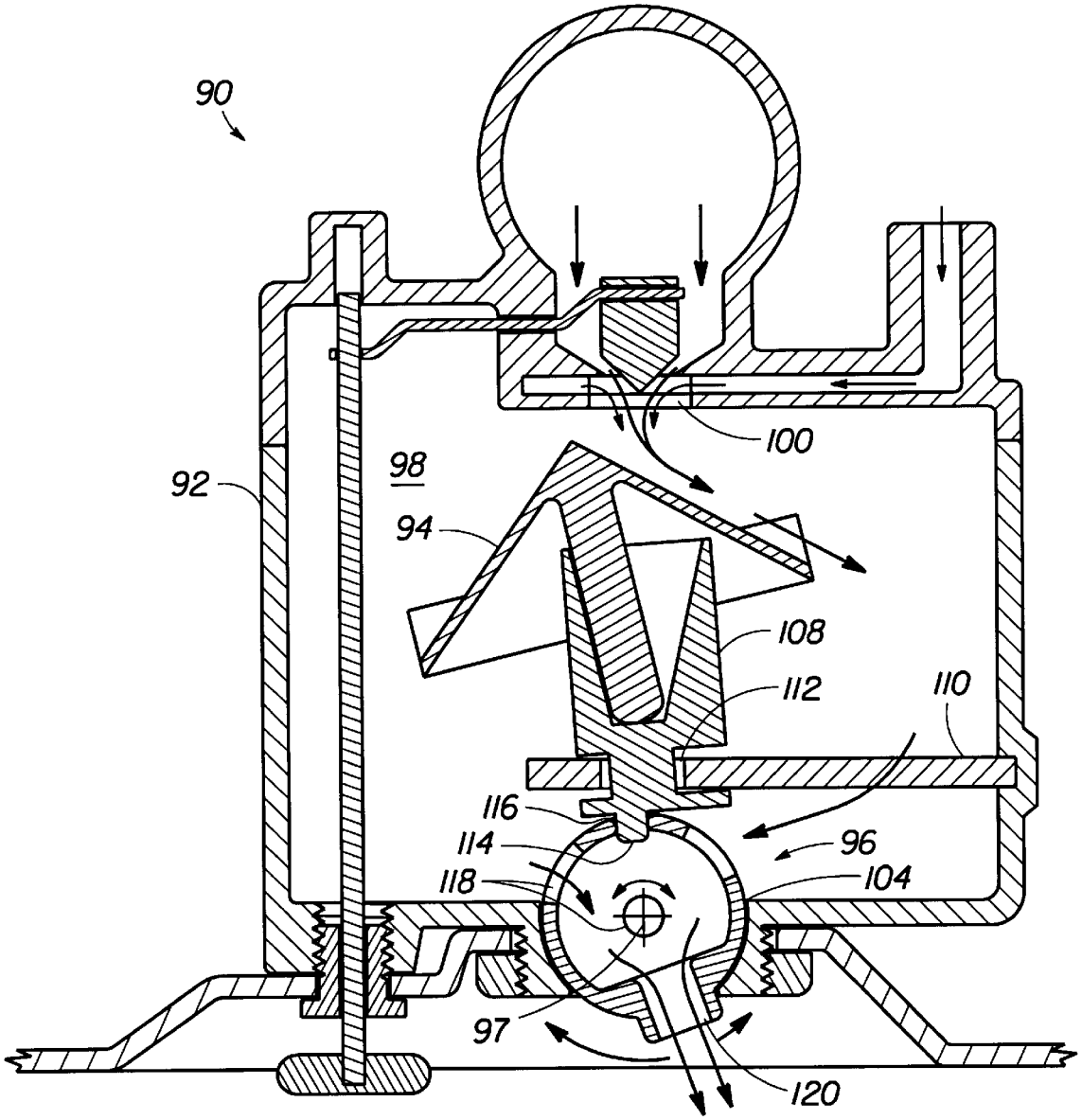
FIG. 4 is a cross-sectional side view of a fourth embodiment of an apparatus of the present invention.

FIG. 4 is a sectional view of an alternative apparatus of the present invention. The apparatus 90 provides a housing 92 for holding a wobble turbine 94 and a nozzle assembly 96. The housing 92 forms a chamber 98 with a fluid inlet 100 positioned upstream of the wobble turbine 94. The housing 92 has a floor 102 that defines an opening 104 therethrough for supporting the nozzle assembly 96. The wobble turbine 94 is slidably received in a sleeve 108 having an open upper end. The housing 92 has a support member 110 attached thereto, where the support member 110 defines a bore 112 therethrough for slidably receiving the lower end of the sleeve 108. The lower end of the sleeve 108 has a drive pin 114 extending therefrom that is positioned off center of the longitudinal axis of the sleeve 108.

The nozzle assembly 96 defines an opening or drive slot 116 therein for receiving the drive pin 114, so that when the wobble turbine 94 wobbles the wobble motion is converted to a rotary motion that is translated to the nozzle assembly 96 through the drive pin 114. The nozzle assembly is fixed to the housing about axle 97 allowing a side to side movement to the nozzle outlet 120. A ball and socket joint may also be used to fix the nozzle assembly to the housing thereby allowing a circular or arcuate movement of the nozzle outlet 120. Alternatively, the shape of the drive slot 116 can be designed to produce an oscillating side to side pattern or an oval shaped fluid pattern exiting the nozzle. It should be recognized that the wobble/sleeve/support/ drive pin assembly may be considered to be a water powered motor which may drive any number of devices known to those skilled in the art.

The nozzle assembly 96 defines a fluid passage that is in fluid communication with a plurality of fluid inlets 118 inside the housing and a fluid outlet channel 120 outside the housing 92. The fluid inlets 118 preferably extend through the wall of the nozzle assembly 96 at a slight angle. The nozzle assembly 96 can be spherical, round, elliptical or oval in shape depending on the desired flow pattern of water exiting the nozzle or fluid outlet channel 120.

In use, water contacts the top of the wobble turbine 94 causing it to wobble within the sleeve 108. The sleeve 108 in turn wobbles, generating rotation from its contact with support member 110, moving the drive pin 114 in a generally circular motion where the center of the drive pin is not in alignment with the longitudinal axis of the sleeve 108. As shown in FIG. 4, the wobbling sleeve 108 acts as a motor to rock the nozzle assembly 96 in a back and forth motion about the axle 97 to produce a sweeping pattern of water exiting the nozzle 120.

The water flow can be aerated by delivering air into the chamber through a port. The water flow into the chamber may be restricted by activating a needle valve shown or a gate valve as discussed previously.

FIG. 5 is a sectional view of another embodiment of the present invention. The apparatus 122 has a housing 124 for holding a wobble turbine 126 and a nozzle 128. The housing 124 defines a chamber 130 with an inlet 132 in one end and a collar 134 or opening in the opposite end. The fluid inlet 132 comprises a tube 136 that extends a distance into the chamber 130.

The wobble turbine 126 has a lower end that is integral with the nozzle assembly. The top surface of the wobble turbine 126 has vanes 144 that are preferably located on the periphery of the upper surface to reduce the speed of the wobble turbine. The chamber 130 also forms a track 138 between the tube 136 and the inner wall of the chamber 130. The wobble turbine 126 has a conical upper surface with a shaft 140 extending therefrom. The shaft 140 has a tracking wheel 142 that is sized to be received by the track 138 formed by the chamber 130. The shape of the track 138 can be modified to reflect the desired flow pattern exiting the nozzle such as circular, oval, elliptical etc. Because the tracking wheel has a much smaller circumference than the track, the turbine makes several revolutions to produce a single wobble, therefore effectively producing a very slow wobble speed.

The nozzle assembly forms a passage 146 in fluid communication with a plurality of inlets 148 located inside the housing 124 and an outlet channel 150 located outside the housing 124. The inlets 148 preferably extend through the wall of the nozzle assembly 128. The outlet channel 150 can consist of one channel or a plurality of outlet channels as described above in FIGS. 2 and 3.

The nozzle assembly is supported by a frusto-conical shoulder 152 that faces the floor 154 of the housing. The shoulder 152 is tapered so that it is in rolling contact with the floor 154 of the housing as the wobble turbine imparts the wobbling motion to the nozzle assembly 128. The angle of tilt achieved by the wobble turbine is limited by the track and tracking wheel relationship.

FIG. 6 is a sectional view of a movable jet outlet that could be used in the nozzle assembly in place of the outlet channels 80 shown in FIGS. 2 and 3. The end of the nozzle assembly 52 can be adapted to receive an outlet jet 81 having a plurality of outlet channels extending therethrough. The outlet jet 81 may form a ball secured in a socket so that the angular position of the outlet jet 81 may then be adjusted by the user with their hands. Preferably, the ball is secured in the socket under sufficient friction to avoid relative slippage during use, but may be easily adjusted by a user. The outlet channels formed in the two independent hemispheres of the ball can be positioned at a diverging angle from one another as shown in FIG. 2 or at essentially parallel to one another. One of ordinary skill in the art would appreciate the multitude of usable angles for the outlet channels.

Figure 7:
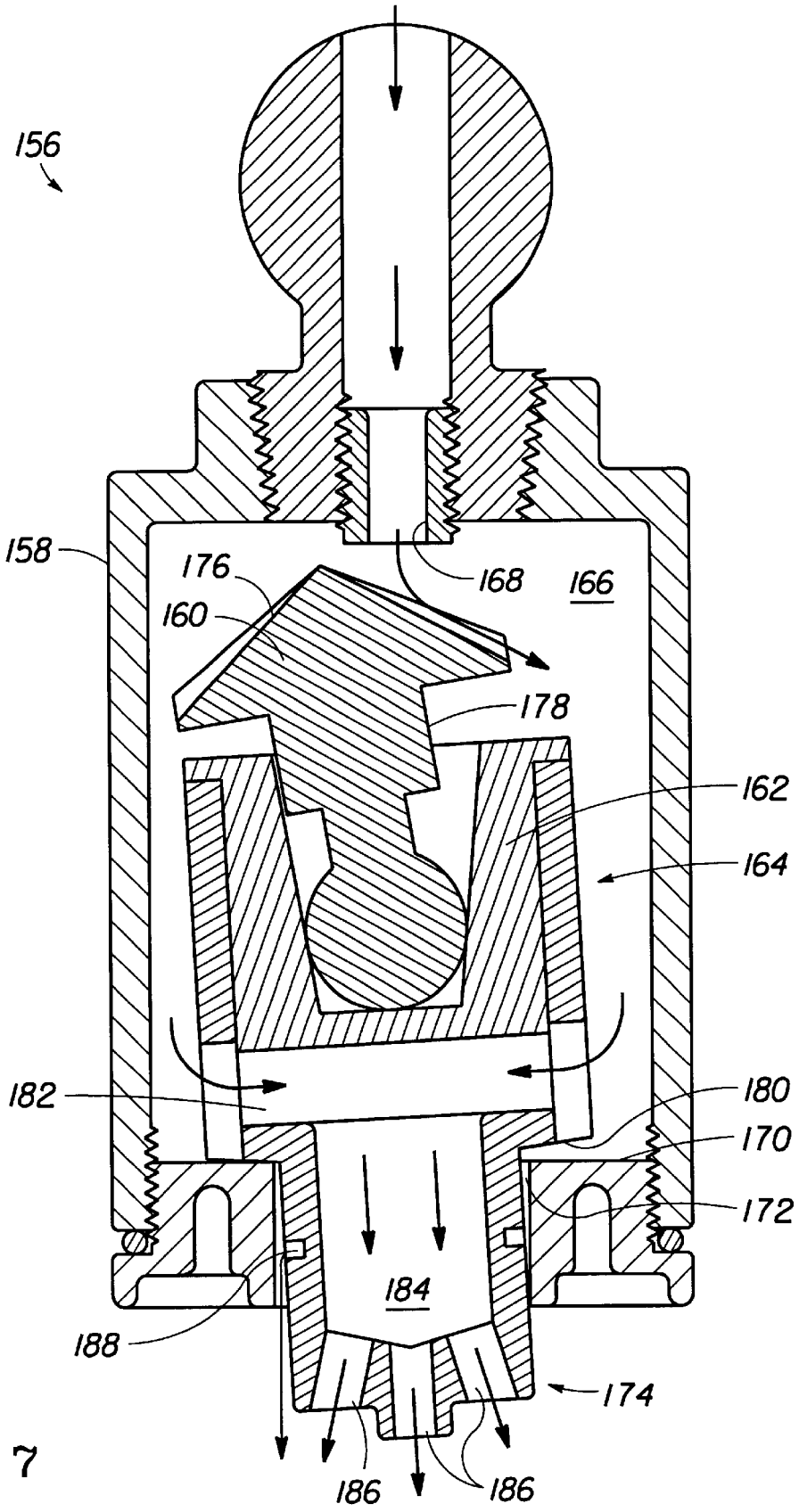
FIG. 7 is a cross-sectional side view of a sixth embodiment of an apparatus of the present invention.

FIG. 7 is a sectional view of another embodiment of the present invention. The apparatus 156 has a housing 158 for holding a wobble turbine 160 similar to that shown in FIG. 1. However, the wobble turbine 160 is loosely received in a sleeve 162 which is part of the nozzle assembly 164. The housing 158 forms a chamber 166 with an inlet 168 positioned upstream from the wobble turbine 160. The floor or distal end 170 of the housing forms a collar, hole or opening 172 therethrough for slidably receiving the nozzle assembly 164, which has a nozzle 174 communicating outside the housing and the sleeve 162 for supporting the wobble turbine 160 inside the housing.

The wobble turbine 160 has a conical upper surface 176 like the one described in FIG. 1, that is attached to a post 178. The upper surface 176 of the wobble turbine 160 preferably extends beyond post 178 to form an annular overhang. The outer diameter of the slightly frusto-conical post 178 is smaller than the inner diameter of the frusto-conical surface of the sleeve 162 such that when the wobble turbine wobbles within the sleeve, the wobbling motion is translated to the nozzle assembly 164.

The nozzle assembly 164 provides an annular shoulder portion 180 that rests on the floor of the housing, fluid inlets 182 positioned above the annular shoulder 180, and forms a passage 184 in fluid communication with the inlet(s) 182 and the nozzle 174. The inlets 182 preferably form a plurality of channels that extend through the wall of the nozzle. The nozzle has a plurality of outlet channels 186, in fluid communication with the passage 184. Preferably, one of the outlet channels 186 is in alignment with the centerline of the nozzle assembly and the remaining outlet channels are angled away from each other off the centerline of the nozzle assembly 164.

The opening or collar 172 has a slightly larger inner diameter than the outer diameter of the nozzle assembly 164. This difference in diameter acts to control the speed of rotation of the nozzle assembly 164. For example, if the inner diameter of the opening 172 is 0.51 inches and the outer diameter of the nozzle assembly is 0.5 inches, with each wobble of the wobble turbine 160, the nozzle assembly will rotate about 0.0314 inches or about $1/50^{th}$ of its circumference in a direction opposite the wobble, resulting in one complete revolution for every fifty wobbles. If the wobble turbine 160 is wobbling at 1800 rpm, then the nozzle assembly 164 would rotate at about 36 rpm.

The water inside the housing 158 may exit down the nozzle between the nozzle and the collar 172, causing a random spray emitted from the nozzle assembly. In order to prevent a pressure build-up by the water between the collar and the nozzle, a groove 188 can be formed in the nozzle assembly 164. Therefore, when the water flows down the outside of the nozzle, the groove will relieve the pressure and allow the water to pass along the outer surface of the nozzle to join the fluid exiting channels 186.

Figure 8:
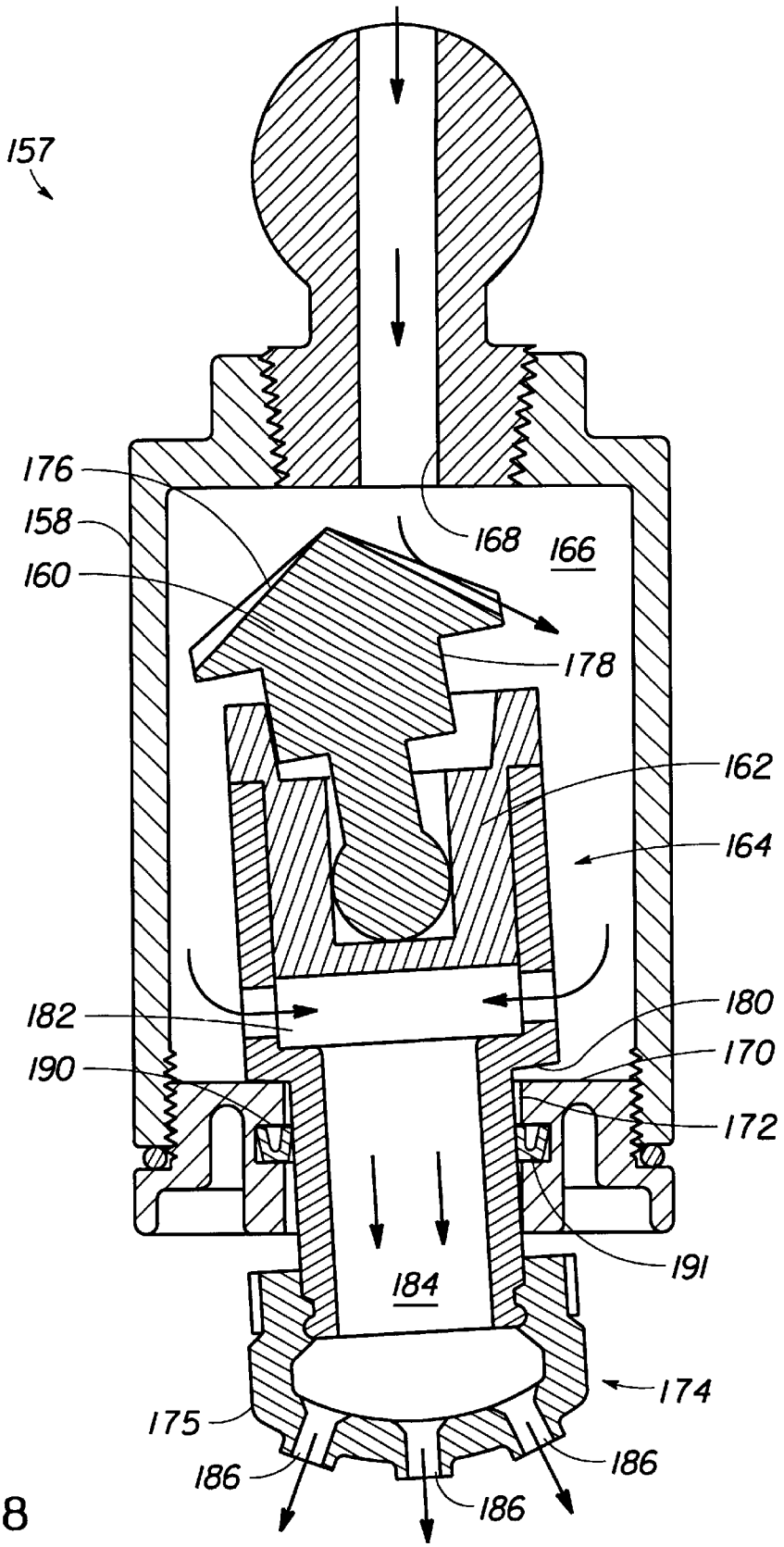
FIG. 8 is a cross-sectional side view of a seventh embodiment of an apparatus of the present invention.

FIG. 8 is a sectional view of an apparatus 157 similar to that shown in FIG. 7, where similar parts bear the same number. In this embodiment, a groove 190 can be formed in the collar 172 to achieve the same result as in the apparatus shown in FIG. 7. In addition, the groove may be fitted with a sealing element 191 such as an o-ring etc. to keep the water from exiting. The tip of the nozzle 174 may be made from or covered with a resilient material 175 such as rubber, so that the nozzle tip can be flexed to break up and remove lime or other mineral deposits easily.

Figure 9:
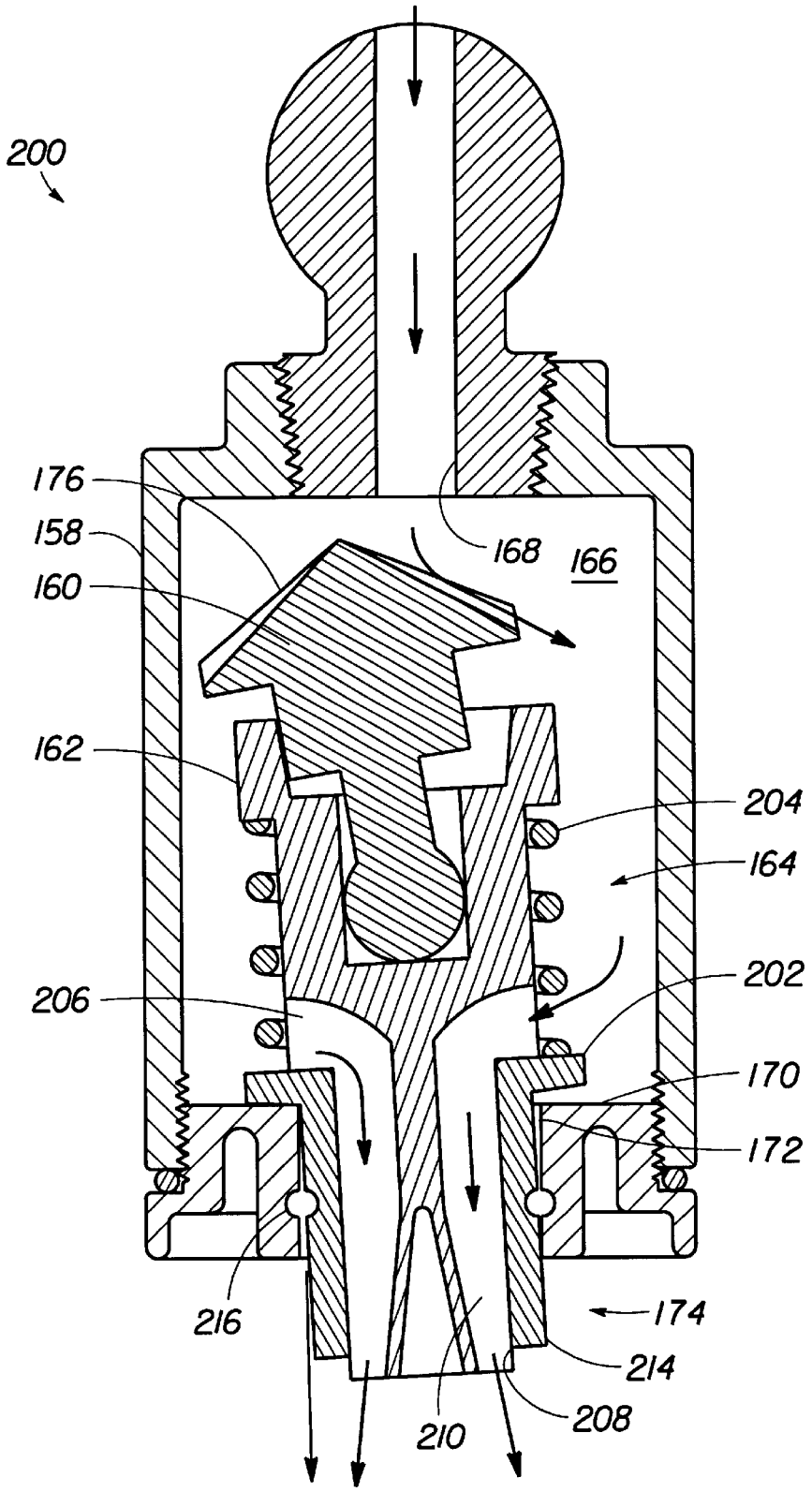
FIG. 9 is a cross-sectional side view of a eighth embodiment of an apparatus of the present invention.

FIG. 9 is a sectional view of an apparatus 200 similar to that shown in FIG. 7, where similar parts bear the same number. The apparatus 200 has a housing 158 for holding a wobble turbine 160 similar to that shown in FIG. 1. The wobble turbine 160 is loosely received in a sleeve 162 that is part of the nozzle assembly 164. The floor 170 of the housing forms a collar, hole or opening 172 therethrough for slidably receiving the nozzle assembly 164, which has a nozzle 174 extending through the housing and the sleeve 162 for supporting the wobble turbine 160 inside the housing. The nozzle assembly also includes in a sleeve 202 forming an annular shoulder 204 that rests against the floor 170 of the housing. The sleeve 202 has an outer diameter that is smaller than the inner diameter of the collar 172, such that the sleeve 202 and the nozzle assembly 164 are free to rotate within the collar. The nozzle assembly forms a plurality of fluid inlets 206 that are connected to a plurality of outlets 208 via passages 210.

When fluid is supplied to the housing through inlet 168, the fluid pressure pushes down on the wobble turbine 176, compressing spring 204 and pushing the nozzle 174 downward so that the fluid outlets 208 extend past the lower end 214 of the sleeve 202 and release the fluid. When the fluid flow is turned off, the spring 204 forces the nozzle upward, pulling the outlets 208 into the sleeve 202 to prevent lime or other mineral deposits from forming on the nozzle outlets 208. With the proper configuration of fluid inlets 206 this action may also serve to regulate flow as to be constant even when line pressures may vary.

The collar 172 may also form a groove 216, similar to the one shown in FIG. 7, to release water pressure and prevent random sprays. The sleeve 202 may also have a groove to achieve the same purpose as groove 216.

Figure 10:
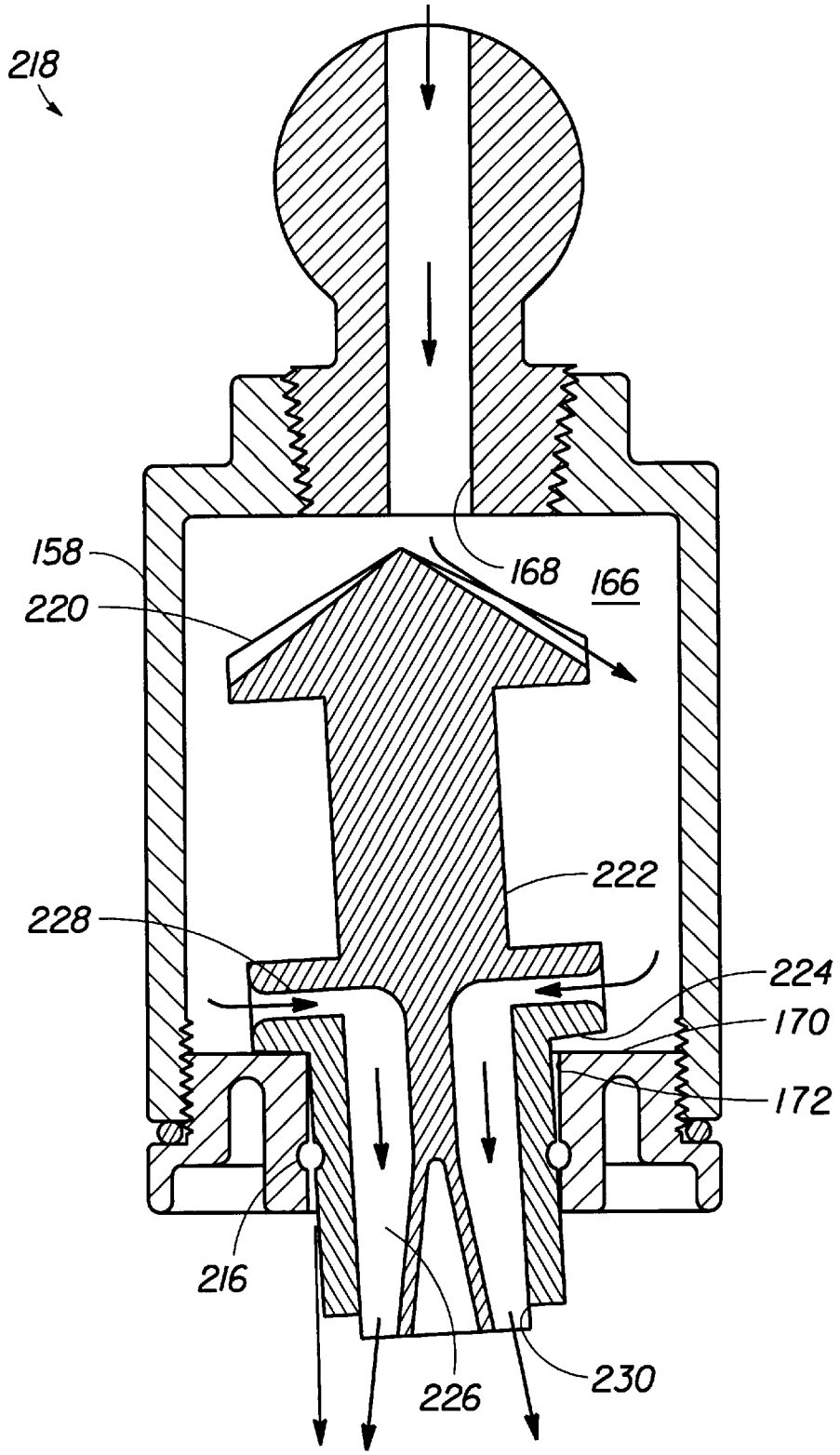
FIG. 10 is a cross-sectional side view of a ninth embodiment of an apparatus of the present invention.

FIG. 10 is a cross-sectional view of an apparatus 218 of the present invention. The apparatus 218 has a housing 158 for holding a wobble turbine 220. The housing 158 forms a chamber 166 with an inlet 168 positioned upstream from the wobble turbine 220. The floor 170 of the housing 158 forms a collar, hole or opening 172 therethrough for slidably receiving a post 222 which is fixed to the wobble turbine 220 inside the housing 158, and a nozzle 226 outside the housing 158. The post 222 is held in a wobbling relationship within the opening 172 by an annular shoulder 224 that allows the post 222 to rotate within the opening 172.

The wobble turbine 220 has a conical upper surface and is similar to the wobble turbine shown in FIG. 7. The post 222 provides passages 226 in fluid communication between fluid inlet(s) 228 and fluid outlets 230 there are preferably a plurality of inlet channels 228 that extend through the wall of the post, preferably radially toward the centerline of the post.

Therefore, fluid follows a pathway by entering the chamber 166 through the inlet 168, passing over the wobble turbine 220, entering through inlet 228 into the passage 226 in the post 222, and exiting the nozzle through one or more spray channels 230 in fluid communication with the passage 226 in the post 222. In operation, a fluid source under pressure is in communication with the inlet 168 in the housing 158. The pressure from the water entering the housing exerts forces on the post 222 pushing the post 222 downward and allowing the turbine to wobble. The turbine 220 wobbles due to the fluid flowing over the upper surface of the wobble turbine 220. Once the chamber is substantially filled with water, water therein enters the inlet in the post and flows through a passage in the post to the outlet channels in the nozzle. This design is particularly useful for use with high pressure water streams to produce a shower for bathing and the like.

Figure 11:
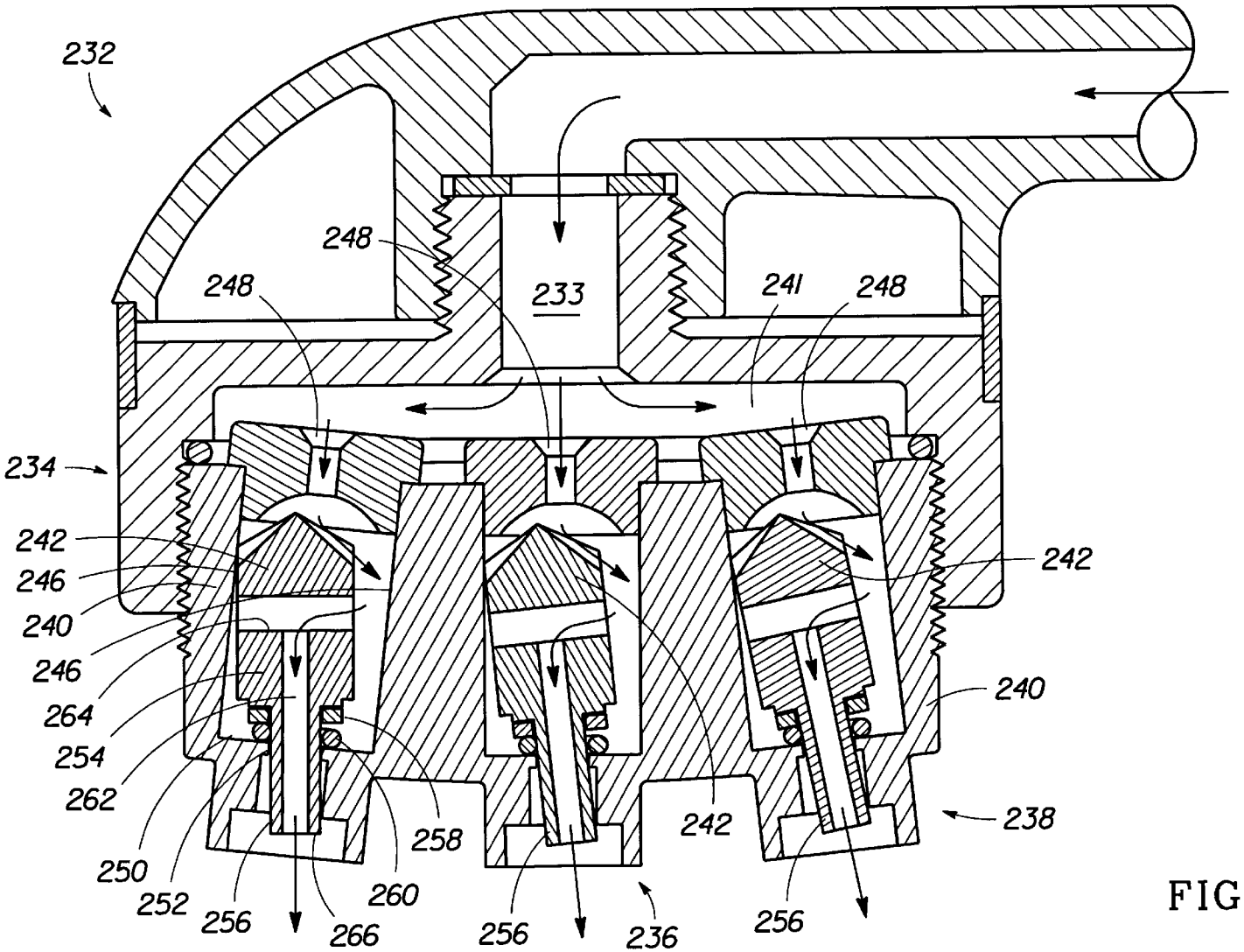
FIG. 11 is a cross-sectional side view of a tenth embodiment of an apparatus of the present invention.

FIG. 11 is a cross-sectional view of an apparatus of the present invention having a plurality of nozzles. The apparatus 232 is shown as a multiple-nozzle hand-held shower unit in fluid communication with a single water inlet 233, but the individual spray heads may be used in single-nozzle units and the multiple-nozzle housing may be used in association with other spray heads in accordance with the invention. While there may be any number of elements, there are preferably between 5 and 15 elements. Most preferably, there are seven (7) elements arranged with one central element and six elements located in a circle around the central element, wherein three such elements 234, 236, 238 are shown in the cross-sectional view. In a preferred embodiment, each of the elements 234, 236, 238 have the same constituent parts, therefore only element 234 will be described in detail herein.

This multiple-nozzle unit 232 provides fluid communication from a water source through inlet 233 to each of the elements 234, 236, 238 by providing fluid distribution passages or a chamber 241 which is sufficiently open and unrestricted to avoid causing any significant pressure drop in the fluid before it reached the individual elements. The chamber 241 is in fluid communication with each element through individual fluid inlets 248 to each element which direct the fluid against the wobble turbine 242. After the fluid passes over the wobble turbine, it is redirected into and through the wobbling nozzle 256.

Each element 234 has a housing 240 for holding a wobble turbine 242. The housing 240 forms a wall or track 246 adjacent the fluid inlet 248 positioned upstream from the wobble turbine 242. The floor or distal end 250 of the housing 240 forms a collar, hole or opening 252 therethrough for slidably receiving a post 256 which is preferably fixed to the body 254 of the wobble turbine 242 inside the housing 240. The post 256 and body 254 provide a fluid passage for communicating fluid from the housing 240 to the nozzle opening 266. The post 256 is held in a wobbling relationship within the opening 252 by an annular shoulder 258 that allows the post 256 to rotate within the opening 252. A washer, o-ring or bearing 260 may optionally be placed between the annular shoulder 258 and the distal end of the housing 240. In accordance with this construction, a portion of the cylindrical side wall of the wobble turbine 242 will track along the inside wall 246 of the housing 240.

While each housing on the multiple element unit must form a track or wobble limiting member of some kind, it is possible that the unit 232 could allow open fluid communication between the elements after the fluid has passed through the inlets 248. In this manner, the essential components of the unit include (a) a pan having a perimeter wall, a floor and multiple collars 252 through the floor, (b) a plurality of wobble turbines, each wobble turbine having a nozzle extending through one of the collars, and (c) a fluid distribution manifold providing a fluid jet aligned with each collar, (d) a wobble limiting member for each wobble turbine. In the embodiment shown, the manifold is formed by a a fluid distribution plate secured above the floor of the pan, the fluid distribution plate having multiple inlets aligned with the collars. Furthermore, the wobble limiting members are formed by walls extending between the pan floor and the bottom of the fluid distribution plate, although it is not necessary for the wall to prevent flow between the housings or even to extend beyond the provision of a wobble limiting member.

For each element, the turbine body 254 has a fluid inlet(s) 264 and a passage 262 that provides fluid communication between the inside of the housing 240 and the fluid nozzle outlet 266. It is preferred that the turbine body include a plurality of inlet channels 264 that extend through the wall of the post, preferably radially toward the centerline of the post.

Therefore, fluid follows a pathway by entering the apparatus through inlet 233 passing into the housing 240 through the inlet 248, passing over the wobble turbine 242, entering through inlet 264 into the passage 262 in the turbine body 254, and exiting the nozzle 256 through fluid outlet 266 in fluid communication with the passage 262. The fluid outlet 266 may be a simple outlet as shown or contain multiple ports as the same or different angles (as in FIG. 7).

In operation, a fluid source under pressure is in communication with the inlet 233 in the apparatus 232. The pressure of the water entering the apparatus causes water to flow to through the individual inlets 248 to the individual wobble turbines 242. The water exerts forces on the turbine 242 pushing the body 254 downward and allowing the turbine 242 to wobble due to the fluid flowing over the upper surface of the wobble turbine 242. Once the housing 240 is substantially filled with water, water therein enters the inlet 264 in the post and flows through a passage 262 in the post to the outlet 266 in the nozzle. This design is particularly useful in a hand held spraying device, but may also be used in a wall mount device. While the device may have any number of nozzles, a preferred device includes between 7 and 12 nozzles. It should be recognized that besides sharing a common source of fluid, the individual elements or wobble turbines operate independent of each other.

Figure 12:
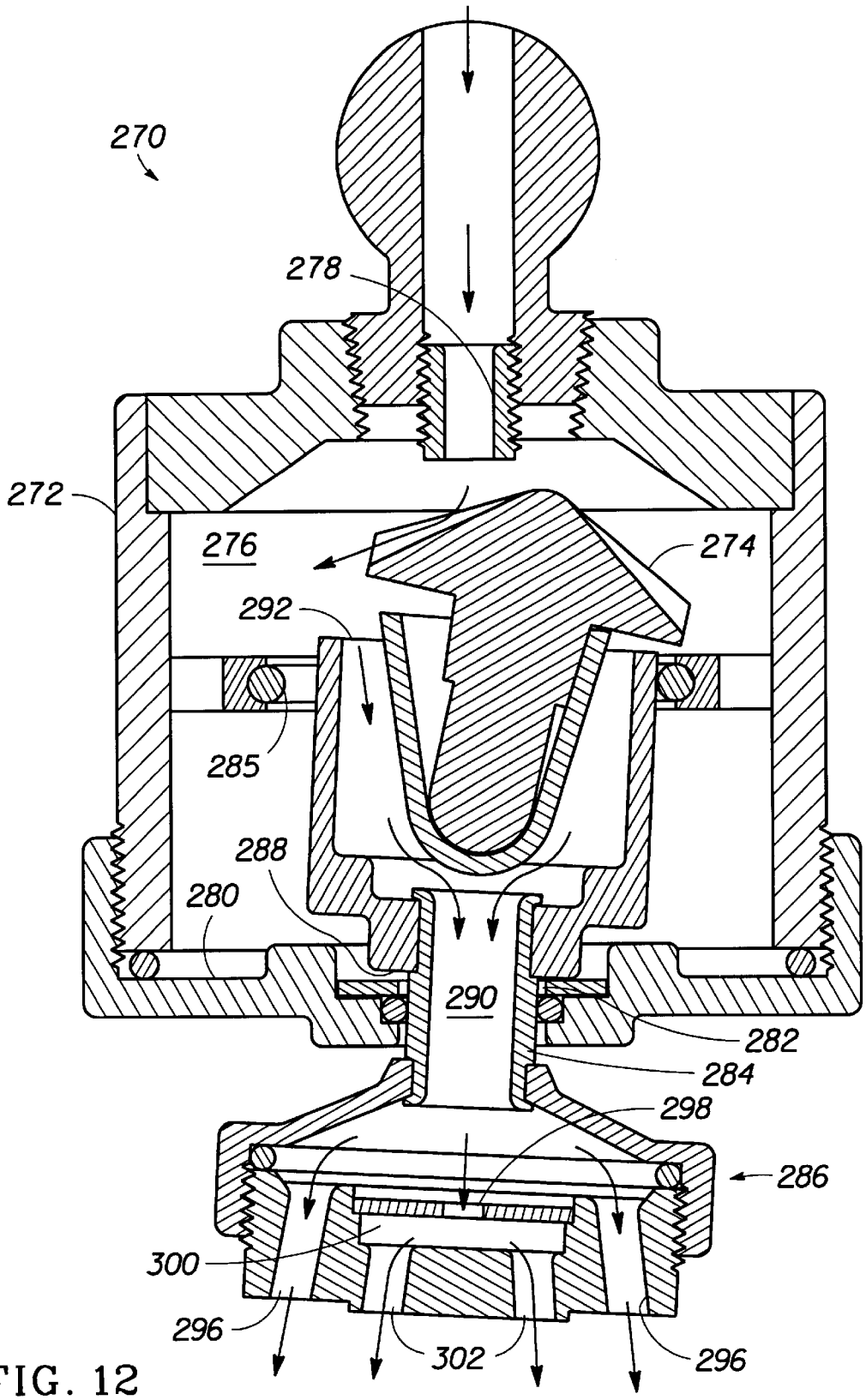
FIG. 12 is a cross-sectional view of an eleventh embodiment of the present invention.

FIG. 12 is a cross-sectional view of an apparatus 270 of the present invention. The apparatus 270 has a housing 272 for holding a wobble turbine 274. The housing 272 forms a chamber 276 with an inlet 278 positioned upstream from the wobble turbine 274. The floor 280 of the housing 272 forms a collar, hole or opening 282 therethrough for slidably receiving a post 284 which is fixed to the wobble turbine 274 inside the housing 272, and a nozzle 286 outside the housing 272. The post 284 is held in a wobbling relationship within the opening 282 by an annular shoulder 288 that allows the post 284 to tilt and rotate within the opening 282. This embodiment employs wobble-limiting, rotation-generating wall contact similar to that of FIG. 11, except that the sleeve extention of the post 284 makes contact, rather than the turbine itself, and the wall extends inwardly and forms a contact surface 285, such as a high friction or plyable surface like an O-ring or other suitable structure.

The wobble turbine 274 has a conical upper surface and is similar to the wobble turbine shown in FIG. 8. The post 284 provides passage 290 in fluid communication between fluid inlet 292 and the nozzle 286. It should be noted that the particular wobble turbine 274 shown here is not limiting in that any of the wobble turbine/post configurations shown herein may be used.

The nozzle 286 has a high pressure chamber 294 that is in fluid communication with the passage 290 and a plurality of high pressure outlet channels 296. The high pressure chamber 294 defines an opening 298 that is in fluid communication with a low pressure chamber 300. The low pressure chamber 300 has low pressure outlet channels 302. A portion of the water flows through the high pressure chamber 294 to the low pressure chamber 300, where it exits the nozzle at a lower pressure than the water exiting the high pressure chamber, thus forming large droplets. The water exiting the high pressure outlet channels 296 forms smaller droplets than the water exiting the low pressure outlet channels 302.

Therefore, fluid follows a pathway by entering the chamber 276 through the inlet 278, passing over the wobble turbine 274, entering through inlet 292 into the passage 290 in the post 284. The fluid then exits the nozzle 286 through either the high pressure outlet channels 296 or the low pressure outlet channels 302. In operation, a fluid source under pressure is in communication with the inlet 278 in the housing 272. The pressure from the water entering the housing 272 exerts forces on the post 284 pushing the post 284 downward and allowing the turbine to wobble. The turbine 274 wobbles due to the fluid flowing over the upper surface of the wobble turbine 274. Once the chamber is substantially filled with water, water therein enters the inlet in the post and flows through a passage in the post to the outlet channels in the nozzle. This design is particularly useful for use with high pressure water streams to produce low and high pressure droplets providing an overall uniform shower for bathing and the like. The lower velocity, large droplets help to remove any pulsing feel of the high pressure droplets because they are out of sync with the high pressure droplets.

Figure 13:
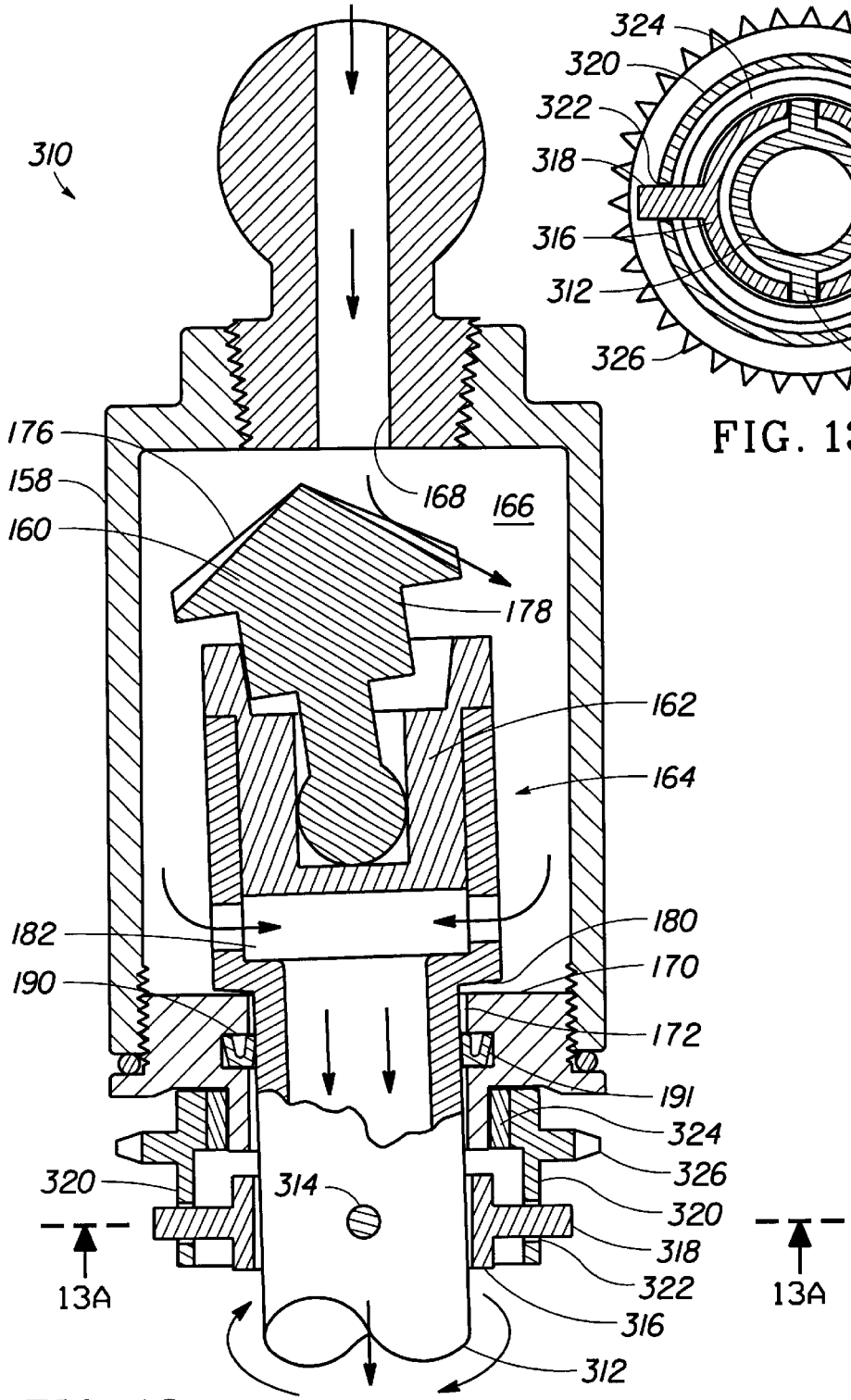
FIGS. 13, 13A and 14 are cross-sectional views of two alternative coupling designs used to harness the roto-nutational movement of a motor output shaft or nozzle assembly and use that movement to turn a gear or shaft, respectively, having a true rotational axis.
Figure 13A:
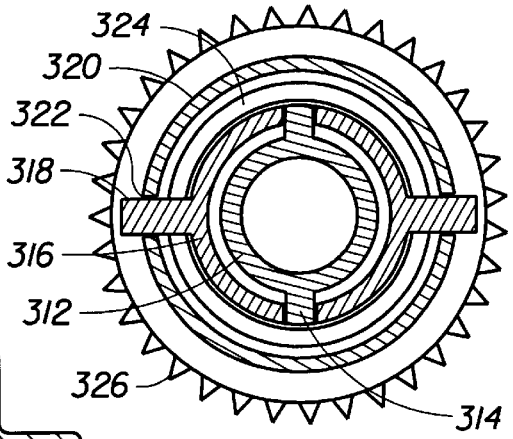
Figure 14:
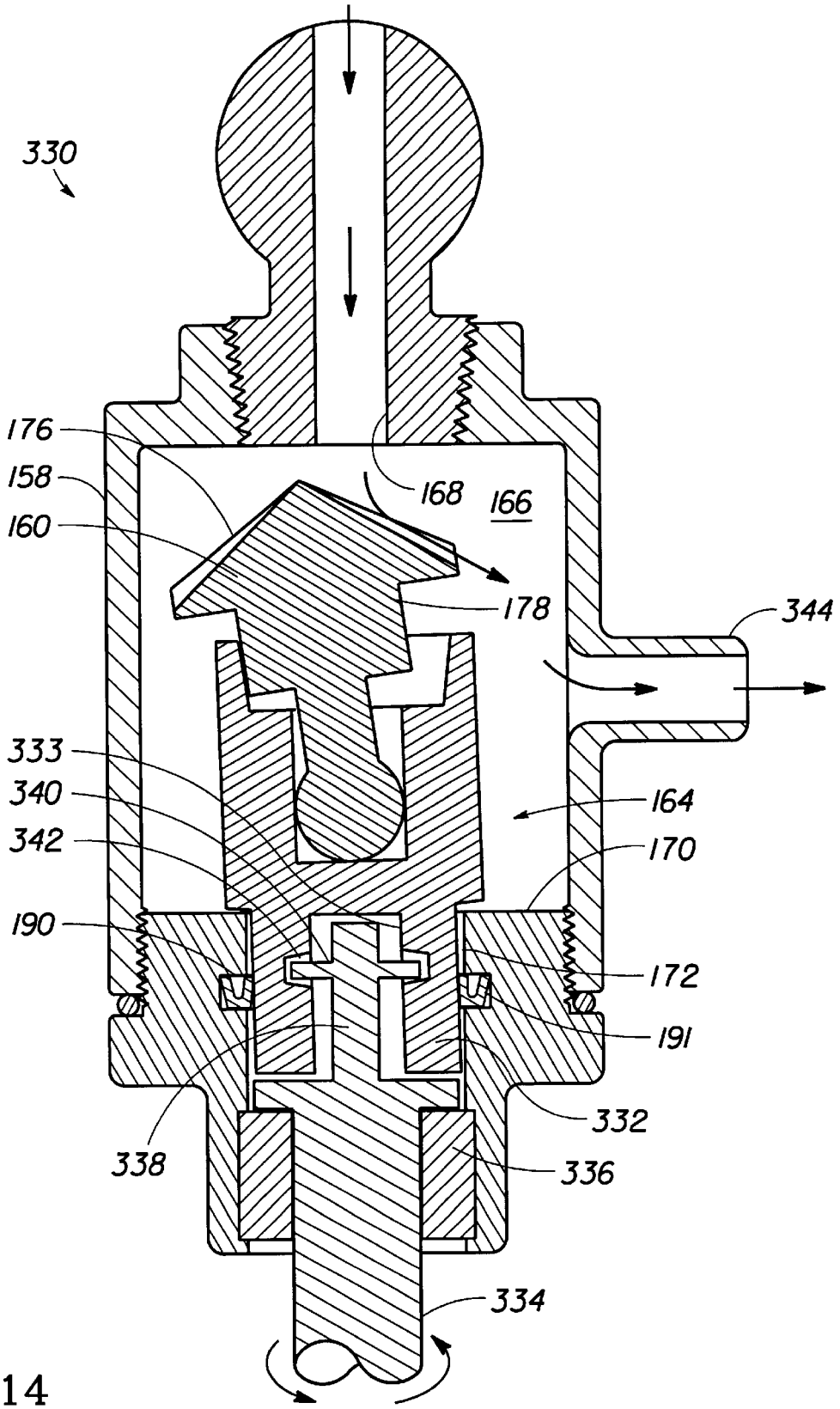

FIGS. 13, 13A and 14 are cross-sectional views of two alternative coupling designs that may be used to harness the roto-nutational movement of the motor output shaft or nozzle assembly 164 and use that movement to turn a gear or shaft, respectively, having a true rotational axis. In both FIGS. 13 and 14, the housing 158, the wobble turbine 160 and the nozzle assembly 164 are essentially the same as in apparatus 157 of FIG. 8, and like reference numerals are used in reference to similar elements. The differences between motors 310 and 330, on the one hand, and the apparatus 157, on the other hand, are directed to additional members attached to the nozzle assembly 164 in place of the nozzle 174 and additional member attached to the floor of the housing 158.

In FIG. 13, the nozzle assembly 164 has an extended post 312 engaged with a "universal" type joint providing at least two degree of freedom that can accommodate the wobbling motion of the nozzle assembly 164. A pin 314 is pivotally engaged through the side of the post 312, or alternatively pivotally attached to the side of the post 312. The outermost ends of the pin 314 are pivotally engaged with an annular ring 316 having dual tabs 318 extending radially therefrom. The tabs 318, in turn, are pivotally engaged with another annular ring 320 having pilot holes 322 therethrough. The annular ring 320 is maintained in true axial alignment by a cylindrical bearing 324 affixed to the bottom of the floor 170 of the housing 158. The ring 320 may then be coupled to or include various drive means, including gear teeth 326 disposed around the perimeter of the ring.

In FIG. 14, the nozzle assembly 164 has a shortened post 332 having a central opening 333 therein. A shaft 334 is maintained in true axial alignment by a cylindrical bearing 336 affixed to the floor 170 of the housing 158. The shaft 334 includes a post 338 that extends into the opening 333. The post 338 includes dual tabs 340 extending radially therefrom into a slots 342 formed within the opening 333 of the nozzle assembly 164. It is an important aspect of the invention that the motor 330 is driven by fluid that does not exit through a nozzle, but rather exits through a separate port 344 and, depending upon the application, may need no chamber at all. Such a separate port may also be incorporated in the housing 158 of FIG. 13, preferably with the post 312 being plugged.

While the foregoing is directed to the preferred embodiment of the present invention, other and further embodiments of the invention may be devised without departing from the basic scope thereof, and the scope thereof is determined by the claims which follow.

What is claimed is:

1. A fluid discharging apparatus comprising:

a housing having a fluid inlet and a collar in an axially spaced relationship to the fluid inlet;

a wobble inducing member disposed within the housing in an axially spaced relationship between the fluid inlet and the collar;

a nozzle assembly coupled to the wobble inducing member in a loose male-female relationship, wherein the nozzle assembly has a fluid conduit extending through the collar to provide fluid communication between the housing and a fluid outlet at a distal end of the conduit;

wobble limiting means extending about the nozzle assembly.

2. The apparatus of claim 1, wherein the wobble inducing member has a plurality of stream distributing members configured to cause the wobble inducing member to rotate when struck by a stream emitted from the fluid inlet.

3. The apparatus of claim 1, wherein the wobble limiting member is a track formed in the housing adjacent the fluid inlet and the wobble turbine is in rolling contact with the track.

4. The apparatus of claim 1, wherein the wobble limiting member is an elongated cylindrical collar.

5. The apparatus of claim 1, wherein the nozzle assembly has a wobble plate and the wobble limiting member is a slot formed in the housing for receiving the wobble plate.

6. The apparatus of claim 1, wherein the nozzle assembly has a slot formed around the circumference of the nozzle assembly, and wherein the wobble limiting member is secured to the housing and forms a plate extending into the slot.

7. The apparatus of claim 1, wherein the wobble limiting member is a wall forming part of the housing.

8. The apparatus of claim 1, wherein the wobble limiting member is a cylindrical sleeve disposed around a portion of the nozzle assembly.

9. The apparatus of claim 8, wherein the portion of the nozzle assembly forms a post.

10. The apparatus of claim 1, wherein the fluid conduit includes one or more radial channels.

11. The apparatus of claim 1, wherein the fluid conduit is not tangential.

12. The apparatus of claim 1, wherein the wobble turbine has a conical upper surface facing the fluid inlet.

13. The apparatus of claim 1, wherein the wobble turbine has a convex conical upper surface with angular momentum inducing grooves formed therein.

14. The apparatus of claim 1, wherein the housing further comprises an air passage extending into fluid communication with the fluid outlet.

15. The apparatus of claim 14, wherein the air passage extends into a position adjacent to the fluid outlet.

16. The apparatus of claim 1, wherein the nozzle assembly forms a shoulder having a greater diameter than the collar.

17. The apparatus of claim 1, wherein the fluid outlet forms a plurality of flow channels.

18. The apparatus of claim 17, wherein the flow channels form an angle with the centerline of the nozzle assembly.

19. The apparatus of claim 1, wherein the nozzle assembly is rigidly coupled to the wobble inducing member.

20. The apparatus of claim 1, wherein the nozzle assembly has a wobble plate and the wobble limiting member is a slot having an adjustable width.

21. The apparatus of claim 1, wherein the collar forms an annular groove therein facing the fluid conduit.

22. The apparatus of claim 1, wherein the fluid conduit forms an annular groove therein facing the collar.

23. The apparatus of claim 1, wherein the collar includes a resilient gasket surrounding the fluid outlet.

24. The apparatus of claim 1, wherein the fluid conduit has a slidable member therein, and wherein a biasing member is coupled to the slidable member to cause sliding contact with the fluid conduit when the fluid pressure changes.

25. The apparatus of claim 1, wherein the wobble limiting member is track disposed around an upper portion of the nozzle assembly.

26. The apparatus of claim 1, further comprising a nozzle having a plurality of outlets in fluid communication with the fluid conduit.

27. The apparatus of claim 26, wherein the nozzle includes a pressurized fluid chamber having a plurality of outlet orifices and a reduced pressure fluid chamber having a plurality of outlet channels.

28. A fluid discharge apparatus comprising:

a housing having a fluid inlet and a collar in an axially spaced relationship to the fluid inlet;

a wobble inducing member disposed within the housing in an axially spaced relationship between the fluid inlet and the collar;

a nozzle assembly coupled to the wobble inducing member in a wobbling relationship, wherein the nozzle assembly has a fluid conduit extending through the collar to provide fluid communication between the housing and a fluid outlet at a distal end of the conduit;

wobble limiting means extending about the nozzle assembly.

29. A fluid discharging apparatus comprising:

a housing having a fluid inlet and a collar in an axially spaced relationship to the fluid inlet;

a wobble turbine disposed within the housing in an axially spaced relationship between the fluid inlet and the collar, the wobble turbine forming a conical surface with partially radial grooves facing the fluid inlet end of the housing;

a nozzle assembly coupled to the wobble turbine, wherein the nozzle assembly has a fluid conduit extending through the collar to provide fluid communication between the housing and a fluid outlet at a distal end of the conduit;

wobble limiting means extending about the nozzle assembly.

30. A fluid discharging apparatus comprising:

a housing having a fluid inlet and a plurality of separate fluid outlets, a plurality of chambers within the housing, each chamber being in communication with the fluid inlet and one of the plurality of fluid outlets;

a wobble turbine positioned within each chamber and in communication with the fluid inlet, whereby fluid flowing from the inlet induces a wobbling motion to each wobble turbine;

a nozzle assembly associated with each wobble turbine and in fluid communication with the fluid inlet, whereby each wobble turbine wobbles independently of the other wobble turbines, and each nozzle assembly has a fluid discharge controlled by its associated wobble turbine.

31. The fluid discharge apparatus of claim 30 wherein each nozzle assembly is attached to and movable with its associated wobble turbine.

32. The fluid discharge apparatus of claim 31 wherein each wobble turbine has a fluid passage therein, and each nozzle assembly has a fluid passage therein connected to the wobble turbine's fluid passage.

* * * * *